United States Patent [19]

Baker

[11] Patent Number: 4,899,631

[45] Date of Patent: Feb. 13, 1990

[54] ACTIVE TOUCH KEYBOARD

[76] Inventor: Richard P. Baker, 112 N. Soledad, Santa Barbara, Calif. 93103

[21] Appl. No.: 198,191

[22] Filed: May 24, 1988

[51] Int. Cl.[4] ..... G10H 3/00; G10C 3/12

[52] U.S. Cl. ..... 84/719; 84/DIG. 7; 84/439; 84/440; 84/433

[58] Field of Search ..... 84/439, 440, 1.1, 1.27, 84/DIG. 7, 433, 1.01, 423, 423 A, 423 B, 433; 318/436

[56] References Cited

U.S. PATENT DOCUMENTS

| | | | |
|---|---|---|---|
| 2,681,586 | 6/1954 | Pressler | 84/1.27 |
| 3,634,593 | 1/1972 | Takehiko | 84/1.01 |
| 3,705,254 | 12/1972 | Amano | 84/1.27 X |
| 3,708,605 | 1/1973 | Ohno | 84/1.15 X |
| 3,845,683 | 11/1974 | Lehmann | 84/1.01 |
| 4,099,439 | 7/1978 | Luce | 84/1.13 |
| 4,111,091 | 9/1978 | Hinago | 84/1.01 |
| 4,121,490 | 10/1978 | Deutsch | 84/1.1 X |
| 4,160,400 | 7/1979 | Schrecongost | 84/1.1 X |
| 4,416,178 | 11/1983 | Ishida | 84/1.27 X |
| 4,426,902 | 1/1984 | Okumura et al. | 84/1.27 X |
| 4,510,836 | 4/1985 | Markowitz | 84/1.27 X |
| 4,558,623 | 12/1985 | Buchla | 84/1.1 |
| 4,562,764 | 1/1986 | Marshall | 84/1.1 |
| 4,628,785 | 12/1986 | Buchla | 84/1.1 |
| 4,628,786 | 12/1986 | Buchla | 84/1.1 |
| 4,699,038 | 10/1987 | Wedge | 84/1.27 X |

FOREIGN PATENT DOCUMENTS

| | | | |
|---|---|---|---|
| 52-31722 | 3/1977 | Japan | 84/1.27 |

*Primary Examiner*—A. T. Grimley
*Assistant Examiner*—Matthew S. Smith
*Attorney, Agent, or Firm*—Drucker & Sommers

[57] ABSTRACT

A keyboard system for an electronic musical instrument of the keyboard type, such as a synthesizer, electronic piano, organ or controller keyboard. The keyboard includes an electromechanical key actuation and sensing element that in combination with electronic processing allows the performer to adjust both tactile and tone control parameters associated with keyboard touch response. The tactile response can be tuned over a broad range and is capable of simulating a light organ touch, heavier "piano key feel" or stiff percussive action. Since any of these features can be selected and adjusted while the performer is playing the keyboard, the keyboard system also has a desirable "real time" capability that does not interfere with musical performance.

42 Claims, 16 Drawing Sheets

DYNAMIC RESPONSE CONTROL ALGORITHM DATA DICTIONARY

INPUTS:

| | | |
|---|---|---|
| REAL | VEL (I) | KEY VELOCITY ESTIMATE 384 FOR KEY I |
| REAL | FRC (I) | KEY FORCE ESTIMATE 386 FOR KEY I |
| REAL | SCL_VEL | VELOCITY SCALE PARAMETER 348 |
| REAL | SCL_FRC | FORCE SCALE PARAMETER 350 |
| REAL | SCL_THD | THRESHOLD SCALE PARAMETER 352 |
| LOGICAL | VELOCITY | VELOCITY MODE STATE 396 |
| LOGICAL | FORCE | FORCE MODE STATE 398 |
| LOGICAL | POWER_ON | POWER ON FLAG |

OUTPUTS:

| | | |
|---|---|---|
| BINARY | KEY_ON (I) | KEY ON/OFF DISCRETE 402 FOR KEY I |
| REAL | RESP_VARI (I) | RESPONSE VARIABLE 400 FOR KEY I |

LOCAL VARIABLES:

| | | |
|---|---|---|
| INTEGER | COUNT (I) | KEY OFF COUNTER FOR KEY I |
| REAL | VEL_ON | KEY ON VELOCITY THRESHOLD |
| REAL | VEL_OFF | KEY OFF VELOCITY THRESHOLD |
| REAL | FRC_ON | KEY ON FORCE THRESHOLD |
| REAL | FRC_OFF | KEY OFF FORCE THRESHOLD |
| REAL | ABS_VEL (I) | ABSOLUTE VALUE OF VEL (I) |
| REAL | ABS_FRC (I) | ABSOLUTE VALUE OF FRC (I) |

CONSTANTS:

| | | |
|---|---|---|
| INTEGER | COUNT_MAX | KEY OFF COUNTER MAXIMUM COUNT |
| REAL | VEL_ON_NOM | NOMINAL KEY ON VELOCITY THRESHOLD |
| REAL | VEL_OFF_NOM | NOMINAL KEY OFF VELOCITY THRESHOLD |
| REAL | FRC_ON_NOM | NOMINAL KEY ON FORCE THRESHOLD |
| REAL | FRC_OFF_NOM | NOMINAL KEY OFF FORCE THRESHOLD |

Fig. 9

Fig. 10a

```
BEGIN "DYNAMIC RESPONSE CONTROL (DRC)"
  IF [POWER _ON = TRUE] THEN
        "DRC POWER ON INITIALIZATION, FIG. 10B"
  ENDIF
  "UPDATE DRC PARAMETERS  & STATES, FIG. 11A"
  FOR I = 1, 88 INCREMENT 1
        "SELECT & SCALE RESPONSE VARIABLE FOR KEY I,  FIG. 11B"
        "UPDATE KEY _ ON STATUS FOR KEY I, FIG. 12"
  NEXT I
END "DYNAMIC RESPONSE CONTROL DRC"
```

```
BEGIN "DRC POWER ON INITIALIZATION"

        FOR I = 1, 88 INCREMENT 1

              COUNT (I) = 0
              KEY_ON (I) = 0
              RESP_VAR (I) = 0.0

        NEXT I

END "DRC POWER ON INITIALIZATION"
```

Fig. 10b

```
BEGIN "UPDATE DRC  PARAMETERS & STATES"

  READ PERFORMER INPUTS:

  SCL_VEL = READ [VELOCITY SCALE PARAMETER 348]
  SCL_FRC = READ [FORCE SCALE PARAMETER 350]
  SCL_THD = READ [THRESHOLD PARAMETER 352]


  VELOCITY = READ [VELOCITY MODE STATE 396]
  FORCE    = READ [FORCE MODE STATE 398]

  SCALE VELOCITY AND FORCE THRESHOLDS:

  VEL_ON = SCL_THD * VEL_ON_NOM
  VEL_OFF = SCL_THD * VEL_OFF_NOM
  FRC_ON = SCL_THD * FRC_ON_NOM
  FRC_OFF = SCL_THD * FRC_OFF_NOM

END "UPDATE DRC PARAMETERS & STATES"
```

Fig. 11a

```
BEGIN "SELECT & SCALE RESPONSE VARIABLE FOR KEY I"

  READ VELOCITY & FORCE VARIABLES FOR KEY I:

  VEL (I) = READ [KEY VELOCITY ESTIMATE 384 FOR KEY I]
  FRC (I) = READ [KEY FORCE ESTIMATE 386 FOR KEY I]

  ABS_VEL (I) = ABSOLUTE VALUE [VEL (I)]
  ABS_FRC (I) = ABSOLUTE VALUE [FRC (I)]

  SELECT & SCALE RESPONSE VARIABLE FOR KEY I:

  IF [FORCE = TRUE] THEN

        RESP_VAR (I) = SCL_FRC * ABS_FRC (I)

  ENDIF

  IF [VELOCITY = TRUE ] THEN

        RESP_VAR (I) = SCL_VEL* ABS_VEL (I)

  ENDIF

END "SELECT & SCALE RESPONSE VARIABLE FOR KEY I"
```

Fig. 11b

```
BEGIN "UPDATE KEY _ON STATUS FOR KEY I"
        IF [VEL (I) > VEL_ON] THEN
                IF [FRC (I) > FRC_ON] THEN
                        KEY_ON (I) =1
                ENDIF
        ENDIF
        IF [KEY_ON = 1] THEN
                IF (ABS_VEL (I) < VEL_OFF] THEN
                        IF (ABS_FRC  (I) < FRC_OFF] THEN
                                COUNT (I) = COUNT (I) + 1
                        IF [COUNT (I) > COUNT_ MAX] THEN
                                KEY_ON (I)  = 0
                                COUNT (I) = 0
                        ENDIF
                ENDIF
        ENDIF
  ENDIF
END "UPDATE KEY_ON STATUS FOR KEY I"
```

*Fig. 12*

Fig. 13

MIDI INTERFACE CONTROL ALGORITHM DATA DICTIONARY

INPUTS:

| | | |
|---|---|---|
| REAL | RESP_VAR (I) | RESPONSE VARIABLE 400 FOR KEY I |
| BINARY | KEY_ON (I) | KEY ON/OFF DISCRETE 402 FOR KEY I |
| BINARY | KEY_SW (I) | KEY SWITCH ON/OFF DISCRETE FOR KEY I |
| LOGICAL | PIANO | PIANO MODE STATE 392 |
| LOGICAL | PERCUSSION | PERCUSSION MODE STATE 394 |
| LOGICAL | POWER_ON | POWER ON FLAG |
| INTEGER | OFFSET | OFFSET PARAMETER 356 |

OUTPUTS:

| | | |
|---|---|---|
| INTEGER | INDEX | ACTIVE KEY MIDI BUFFER INDEX |
| REAL MIDI_KEY_ON (J) | | MIDI KEY STATUS BUFFER FOR ACTIVE KEY J |
| REAL MIDI_KEY_ (J) | | MIDI KEY NUMBER BUFFER FOR ACTIVE KEY J |
| REAL MIDI_VELOCITY (J) | | MIDI VELOCITY BUFFER FOR ACTIVE KEY J |

LOCAL VARIABLES:

| | | |
|---|---|---|
| LOGICAL | NOTE _ON (I) | NOTE ON/OFF STATUS FOR KEY I |
| LOGICAL | FIRST_ON (I) | FIRST ON FLAG FOR KEY I |

CONSTANTS:

| | | |
|---|---|---|
| INTEGER | INDEX_MAX | MIDI BUFFER INDEX UPPER LIMIT ($1 \leq J \leq$ INDEX _MAX ) |

```
BEGIN "MIDI INTERFACE CONTROL (MIC)"
  IF [POWER _ ON = TRUE]  THEN
        "MIC POWER ON INITIALIZATION, FIG. 14B "
  ENDIF
  "UPDATE MIC PARAMETERS & STATES, FIG. 15A"
  POLL FOR ACTIVE KEYS:
  FOR I = 1, 88 INCREMENT 1
        "UPDATE NOTE _ ON STATUS FOR KEY I, FIG. 15B"
        IF [NOTE _ ON CHANGES STATE] THEN
              "UPDATE MIDI BUFFER, FIG. 16"
        ENDIF
  NEXT I
END "MIDI INTERFACE CONTROL (MIC)"
```

Fig. 14a

```
BEGIN "MIC POWER ON INITIALIZATION"

        INDEX = 0
        FOR I - 1,88 INCREMENT 1
              FIRST _ ON (I) = FALSE
              NOTE _ ON (I) = TRUE
  NEXT I

END "MIC POWER ON INITIALIZATION"
```

Fig. 14b

```
BEGIN "UPDATE MIC PARAMETERS & STATES"

  READ PERFORMER INPUTS:

  PIANO = READ [PIANO MODE STATE 392]
  PERCUSSION = READ [PERCUSSION MODE STATE 394]
  OFFSET = READ [ SPECIAL PARAMETER 356]

END "UPDATE MIC PARAMETERS & STATES"
```

Fig. 15a

```
BEGIN "UPDATE NOTE _ ON STATUS FOR KEY I"

  KEY _ SW (I) = READ [KEY SWITCH ON/OFF DISCRETE 44A)

  IF [ PIANO = TRUE] THEN

        IF [PERCUSSION = TRUE] THEN
              IF [KEY_ON (I) = TRUE] THEN
                    MODE 3 OR 6:
                    NOTE _ ON (I) = TRUE
                    FIRST _ ON (I) = TRUE
              ELSE
                    IF [KEY_SW (I) = TRUE] THEN
                          IF [FIRST _ ON (I) = TRUE] THEN
                                NOTE_ON (I) = TRUE
                                FIRST _ ON (I) = FALSE
                          ENDIF
                    ELSE
                          NOTE _ON (I) = FALSE
                    ENDIF
              ENDIF
        ELSE
              MODE 1 OR 4:
              NOTE _ON (I) = KEY _ SW (I)
        ENDIF

  ELSE

        IF (PERCUSSION = TRUE) THEN
              MODE 2 OR 5:
              NOTE _ ON (I) = KEY _ON (I)
        ELSE
              DEFAULT TO MODE 1:
              NOTE _ON (I) = KEY _ SW (I)
        ENDIF
  ENDIF

END "UPDATE NOTE_ ON STATUS FOR KEY I"
```

Fig. 15b

```
BEGIN "UPDATE MIDI BUFFER"

  INCREMENT BUFFER POINTER:
  INDEX = INDEX + 1
  IF [INDEX > INDEX _ MAX] INDEX = 1

  SET MIDI KEY STATUS:
  MIDI _ KEY _ ON (INDEX) = NOTE_ON(I)

  ASSIGN MIDI KEY NUMBER:
  MIDI_KEY(INDEX) = I + 20

  IF [PIANO = TRUE] THEN
        IF [PERCUSSION = TRUE] THEN
              IF [FIRST_ON (I) = FALSE] THEN

                    MIDI_KEY (INDEX) = MIDI _ KEY (INDEX) + OFFSET

              ENDIF
        ENDIF
  ENDIF

  ASSIGN MIDI VELOCITY:
  MIDI_VELOCITY (INDEX) = RESP_VAR (I)
END "UPDATE MIDI BUFFER"
```

Fig. 16

ACTIVE TOUCH KEYBOARD

BACKGROUND OF THE INVENTION

The present invention relates to electronic musical performance through keyboard electronic instruments, e.g. synthesizers, electronic pianos, organs and controller keyboards, and more particularly to the performer access to and adjustment of touch response parameters that enhance the expressiveness of such instruments.

The performer's physical input to the keyboard results in a tactile and sonic feedback from the instrument that characterizes its expression. For example, the acoustic piano is generally regarded as a very expressive instrument due in part to the satisfying tactile response of a piano action and the way key velocity influences the sound quality of a note (e.g., loudness, timbre). Accordingly, touch response parameters fall into two categories: those that affect what the performer actually senses through his fingers as he plays a note (e.g., key imbalance, inertia), and those that control the dynamics of individual notes as they are played. (e.g., key velocity).

The piano action has undergone several hundred years of development and consists of nearly one hundred parts per key. Early electronic keyboards had very simple organ type actions consisting of a plastic key and spring that electronically produced a note when the depressed key closed a switch. Musicians trained on acoustic pianos complained that these keyboards lacked expression because the tactile response was "soft" and the sound produced was independent of key velocity.

Electronic keyboards have since incorporated various features to approximate the "piano key feel". For example, weighted wooden keys simulate the static imbalance in a piano action. This imbalance provides a relatively constant restoring force of several ounces and causes the key to track the finger action no matter how rapidly a note is played.

There have been corresponding improvements in the sensing of key dynamics. Velocity sensitive keyboards typically sense key velocity by multiple switch contacts, electrooptical, electrostatic or electromagnetic means. The sensed velocity is in turn used to electronically control the sound quality of the note produced.

Some prior art keyboards include what is known as aftertouch control wherein further depression of the key after it has reached its normally depressed position, alters the quality of the tone. So called pressure sensitive keyboards typically sense aftertouch by a piezoelectric element contacted by the key or compression of a variable resistance conductive strip. Such techniques are generally considered to enhance keyboard expressiveness although no direct analogy to a conventional piano action applies.

A disadvantage to most prior art keyboards that approximate a piano key feel is the simulation of piano key imbalance alone. Dynamic effects such as inertial forces that alter the tactile feedback significantly as a key is played faster, are not simulated. The hammer in a piano action travels approximately two inches for a $\frac{1}{4}$ inch displacement of the key. This mechanical advantage causes the hammer inertia to dominate the total inertia sensed by the performer. At fast tempo this can require peak applied forces that are four or five times the static imbalance. Typically a state of the art weighed key action requires less than twice the imbalance force at similar tempo.

Since evaluation of tactile response is subjective, not all musicians applaud the simulation of piano effects. Some prefer an organ to piano touch because of the quickness of its light touch and ability to trill a note without added exertion. Still others judge tactile response in relationship to the musical piece performed; a controlled pianistic touch may be preferred for classical performance, and the speed of an organ action for more contemporary music.

Because the tactile response parameters are fixed by the physical properties of the key mechanism, the performer must settle for the manufacturer's notion of "optimum key feel" without any provision to tailor response to personal preference.

A further disadvantage is that prior art keyboards usually do not monitor the dynamic interaction of performer and key over the full extent of key travel. For example, velocity sensing often occurs only as the key nears the keybed and aftertouch control senses applied pressure after the key is fully depressed. The switch closure that initiates sound generation is also located near the end of travel. Continuous sensing of the performer's applied force and key velocity, and the ability to control note on/off at some interim key position are not generally implemented.

Consequently, the prior art while overcoming some deficiences of early electronic keyboards, has not fully realized the touch response capability or variability of key operated electronic instruments. This includes accurate simulation of a "piano key feel" and features that produce effects dissimilar to a conventional piano or organ that nonetheless improve the expressiveness of the instrument.

SUMMARY OF THE INVENTION

The keyboard system of the present invention, in accordance with preferred embodiments thereof, overcomes the problems and disadvantages of prior art keyboard electronic instruments by providing an electromechanical key actuation and sensing element that in combination with appropriate electronic processing allows the performer to adjust both tactile and tone control parameters associated with keyboard touch response.

Unlike prior art, the tactile response of the present invention can be tuned over a broad range and is not solely determined by the physical properties of the key mechanism. The keyboard system is capable of simulating a light organ touch, heavier "piano key feel" or stiff percussive action. In addition the system continuously senses key velocity and force for tone control and can trigger note on/off by either mechanical switch, velocity/force thresholds or a combination of both. In the combined mode, a single key depression can produce two notes of different pitch to approximate the intervallic tonal response of a bell.

Touch response variablity is achieved by a feedback control system comprised of a motor driven key, performer interface, musical interface and electronic processor. A unique feature of the invention is the dual function of the motor; mechanically coupled to each key, it serves as both a torque effector and key velocity sensor.

The performer alters the tactile response of the key by adjusting a balance and inertia paramerter provided at the performer interface. These parameters together with a measurement of motor voltage are input to an electronic processor. The output of the processor is a motor control current. The DC component of current causes the motor to exert a static torque on the key thereby altering the effective key imbalance. The AC component alters the effective key inertia by torquing the key in proportion to key acceleration and in a direction to resist performer tactile input.

The motor back electromotive force (EMF) is proportional to motor speed and can be derived from motor voltage and current. Since motor and key are mechanically coupled, the derivation of back EMF provides a means for sensing key velocity. Using this relationship and the equations of motion for a motor driven key, the processor develops estimates of key velocity, acceleration and net force from the measured motor voltage and current. Current commands are computed from the balance and inertia parameters and key acceleration estimate.

A further advantage of the present invention is the application of scaled key velocity or force estimates to tone control. The performer interface provides the ability to select and adjust velocity or force sensitivity. The appropriate response variable is then passed to one or more tone generating devices via the musical interface.

In the prior art, velocity sensitivity is usually limited to a discrete sample of key velocity near the end of travel. Furthermore, force or pressure sensitivity is generally an aftertouch effect since no means is provided to sense forces as the key is depressed and released. The dual function motor overcomes both limitations by sensing the key dynamics continuously.

An additional feature of continuous sensing is the ability to trigger note/on off at any point within the key travel. This is accomplished as the velocity and force estimates exceed performer set thresholds. The performer can also select the more conventional triggering by mechanical switch or a combination of both methods for sounding multiple notes with a single key stroke. For the latter case, the respective notes can be assigned different pitches to produce an intervallic effect.

The above options and adjustments provide the performer with a variety of operating modes. For example, a standard electronic keyboard touch response can be realized by lowering the balance and inertia parameters and selecting a mechanically triggered note on/off with velocity sensitivity. Altering this basic setup with increased balance and inertia settings produces a simulated "piano key feel". Further increase of the tactile parameters and selection of velocity/force controlled note on/off and force sensitivity results in a very stiff percussive action and force sensitive tonal response. Addition of intervallic note effects provides a touch response that is similar to striking a bell.

Since any of the stated features can be selected and adjusted while the performer is playing the keyboard, the present invention also has a desirable "real time" capability that does not interfere with musical performance. Further objects and advantages of the invention will become apparent from a consideration of the drawings and ensuing description of it.

BRIEF DESCRIPTION OF THE DRAWINGS

FIG. 9 is a data dictionary for a dynamic response control algorithm;

FIG. 10*a* is a pseudo code description of a dynamic response control algorithm;

FIG. 10*b* is a pseudo code description of a procedure for initializing a dynamic response control algorithm;

FIG. 11*a* is a pseudo code description of a procedure for updating dynamic reponse controller parameters and states;

FIG. 11*b* is a pseudo code description of a procedure for selecting and scaling dynamic response variables;

FIG. 12 is a pseudo code description of a procedure for updating key on status;

FIG. 13 is a data dictionary for a MIDI interface control algorithm;

FIG. 14*a* is a pseudo code description of a MIDI interface control algorithm;

FIG. 14*b* is a pseudo code description of a procedure for initializing a MIDI interface control algorithm;

FIG. 15*a* is a pseudo code description of a procedure for updating MIDI interface controller parameters and states;

FIG. 15*b* is a pseudo code description of a procedure for updating note on status;

FIG. 16 is a pseudo code description of a procedure for updating a MIDI buffer;

DRAWING REFERENCE NUMERALS

Numerals for Preferred Embodiments

Figure 1:
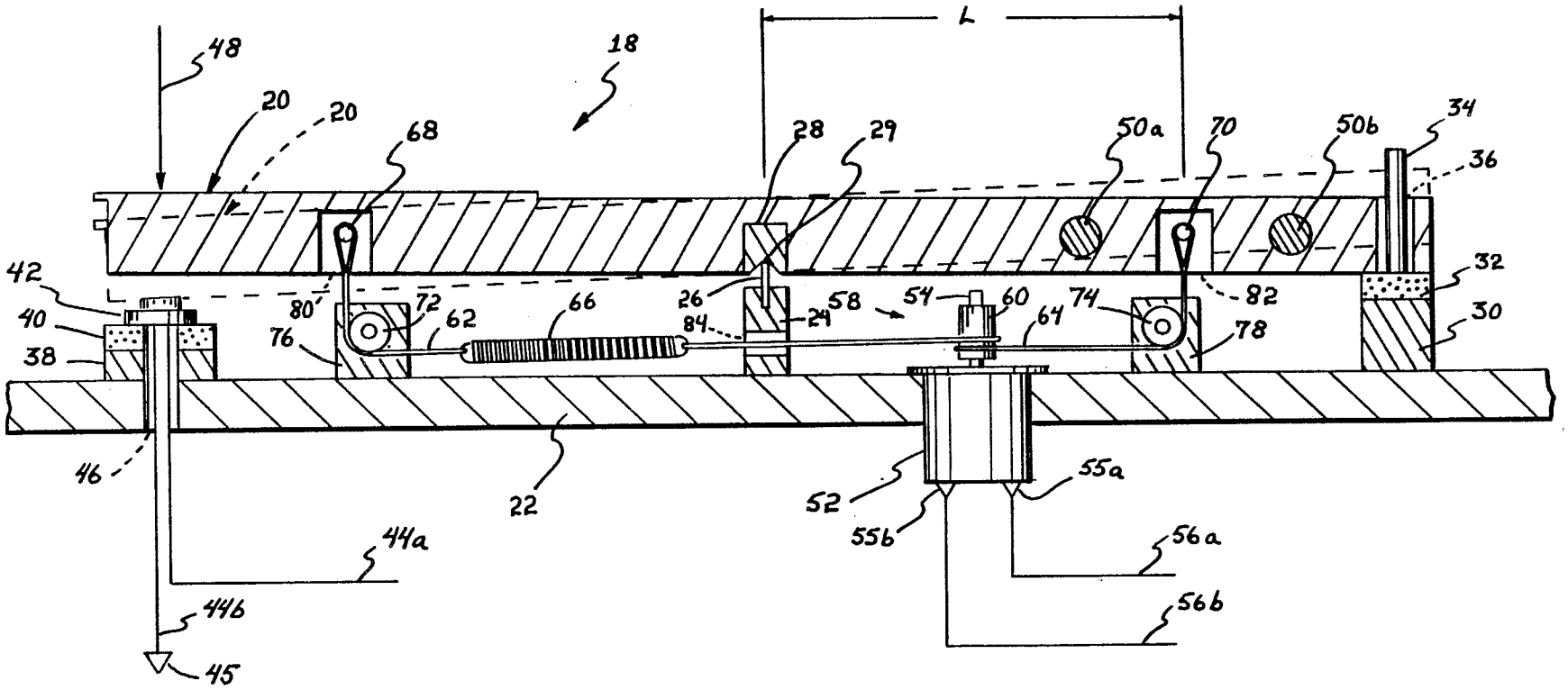
FIG. 1 is a diagrammatic, side elevational view of the keyboard according to an embodiment of the present invention showing the key in its rest position in solid line and in a partially depressed position in dotted line.

18 keyboard
20 playing key
22 base structure
24 balance rail
26 blade
28 vee block
29 fulcrum of key 20
30 rear rail
32 rear cushioning washer
34 guidepin
36 opening in 20 for guidepin 34
38 front rail
40 front cushioning washer
42 electrical switch
44 switch electrical connections a and b
45 keyboard electrical ground

46 common opening in 22, 38 and 40
48 arrow indicating performer input
50 weighted inserts a and b
52 encased motor
54 motor shaft
55 motor terminals a and b
56 motor leads a and b
58 spool drive assembly
60 spool
62 front cable
64 rear cable
66 cable tensioner
68 front cable pin
70 rear cable pin
72 front pulley
74 rear pulley
76 front pulley support
78 rear pulley support
80 opening in 20 for front cable 62
82 opening in 20 for rear cable 64
84 opening in 24
118 keyboard
120 playing key
122 base structure
124 balance rail
129 fulcrum of key 120
130 rear rail
132 rear cushioning washer
134 guidepin
136 opening in 120 for guidepin 134
138 front rail
146 common opening in 122, 138 and 40
150 weight
158 flanged spool drive assembly
160 flanged spool
164 cable
165 end of cable 164
178 pulley support
200 rabbet cut in key 120
202 opening in 122 for cable 164
204 opening in 120 for cable 164
210 key retainer assembly
212 key retainer bracket
214 flexible strip
298 controller keyboard system
300 controller keyboard
301 slave modules
304 MIDI interface a, b and c
306 tone generators a and b
308 electronic keyboard
309 audio outputs a, b and c
310 audio mixer and amplifier
312 speaker
313 performer input
314 MIDI out port
316 MIDI in ports a, b and c
318 MIDI thru ports a and b
320 controller keyboard system 298 parameters a and b
322 controller keyboard system 298 operational modes a and b
328 moding logic
330 motor controller
332 tactile response controller
334 dynamic response controller
336 MIDI interface controller
338 touch response parameters
340 tactile parameters
342 dynamic parameters
344 balance parameter
346 inertia parameter
348 velocity scale parameter
350 force scale parameter
352 threshold scale parameter
354 MIDI parameters
356 offset parameter
374 feedback control system
376 motor current
378 current command
380 motor voltage
382 estimate of motor back EMF
384 estimate of key velocity
386 estimate of net key force
388 MIDI mode
390 touch response mode states
392 PIANO mode state
394 PERCUSSION mode state
396 VELOCITY mode state
398 FORCE mode state
400 response variable
402 key on/off discrete
410 integral of acceleration
412 integral of velocity
414 coulomb friction block
422 current sensing resistor
424 current source
426 current loop
428 series motor resistance
430 back EMF voltage source
432 current amplifier
434 voltage amplifier
436 inverting channel of amplifier 434
436 noninverting channel of amplifier 434
448 derivative of key velocity
450 half wave rectifier

EQUATION SYMBOLS

B positive bias
$F_B$ blade 26 support force
$F_B'$ blade 26 steady state support force
$F_F$ front cable force
$F_P$ performer applied force
$F_P'$ performer steady state applied force
$F_R$ rear cable force
$F_S$ base 22 support force to motor 52
$F_S'$ base 22 steady state support force to motor 52
$I_M$ motor 52 armature current
$J_{EFF}$ effective key 20 inertia
$J_K$ rotational inertia of key 20 about fulcrum 29
$J_{KE}$ equivalent rotational inertia of key 20
$J_M$ rotational inertia of motor 52 rotor and spool 60
$K_S$ motor 52 back EMF constant
$K_b$ balance parameter 344
$K_C$ current amplifier 432 gain
$K_i$ inertia parameter 346
$K_S$ cable tensioner 66 spring constant
$K_T$ motor 52 torque constant
$K_V$ voltage amplifier gain
L spool drive 58 moment arm
$L_M$ motor 52 armature inductance
$L_P$ displacement of performer input 48 from fulcrum 29
$L_W$ displacement of of key 20 C.G. from fulcrum 29
n spool drive 58 drive ratio
r spool 60 radius
$R_M$ motor 52 armature resistance $R_S$ resistance of current sensing resistor 422
$T_{FE}$ key 20 equivalent frictional torque
$T_{FE}'$ key 20 equivalent frictional torque magnitude
$T_{FK}$ key 20 frictional torque
$T_{FK}'$ key 20 frictional torque magnitude
$T_{FM}$ motor 52 frictional torque
$T_{FM}'$ motor 52 frictional torque magnitude
$T_M$ motor 52 torque
$T_M'$ motor 52 steady state torque
$u_C$ motor 52 control command
$U_C$ current command 378
$U_{AC}$ AC component of current command 378
$U_{AC}'$ rectified AC component of current command 378
$U_{DC}$ DC component of current command 378
$V_B$ motor 52 back EMF
$V_B'$ estimate of motor 52 back EMF
$v_K$ linear velocity of key 20
$v_K'$ estimate of key 20 linear velocity
$V_M$ motor 52 voltage
$V_S$ voltage drop across current sensing resistor 422
W weight of key 20
$W_{EFF}$ effective weight of key 20
$\Sigma F$ net key force
$\Sigma F'$ estimate of net key force
$\Sigma F_K$ sum of forces acting through fulcrum 29
$\Sigma F_M$ sum of forces acting through the center of shaft 54
$\Sigma T_K$ sum of torques about fulcrum 29
$\Sigma T_M$ sum of torques about shaft 54
$\theta_K$ angular displacement of key 20
$\theta_M$ angular displacement of motor 52
$\Omega_K$ angular velocity of key 20
$\Omega_K'$ estimate of key 20 angular velocity
$\Omega_M$ angular velocity of motor 52
$\delta_K$ linear displacement of key 20
$\delta_S$ cable tensioner 66 displacement from unextended length

DETAILED DESCRIPTION—DUAL CABLE EMBODIMENT

FIG. 1 is a diagrammatic, side elevational view of a keyboard 18 of a preferred embodiment of the present invention which comprises a plurality of playing keys 20 which are linearly arranged in the usual fashion as in a piano or organ keyboard. Playing key 20 is shown in its rest position in solid line and in a partially depressed position in dotted line. Playing keys 20 may be made of wood, for example, and coated with a plastic and are supported on a base structure 22. A key balance rail 24 is secured to base 22 near the middle point of the length of key 20. A blade 26 protruding from balance rail 24 fits into a vee block 28 which is pressed into a recess in key 20. Blade 26 and vee block 28 serve as the fulcrum 29 for key 20 and constrain side-to-side motion of key 20. A rear rail 30 is secured to base 22 and a rear cushioning washer 32 which rests on top of rail 30, serves to limit the clockwise travel of key 20. A guidepin 34 which protrudes from rear rail 30 and passes through rear cushioning washer 32, is received within an opening 36 within the center portion of key 20 and serves to further constrain the side-to-side motion of key 20.

A front rail 38 which is secured to base 22, a front cushioning washer 40 which rests on top of rail 38 and an electrical switch 42 which is secured to washer 40 serve to limit the counterclockwise motion of key 20. Switch 42 may be a membrane type, for example, and encased in a rubber with electrical connections 44a and 44b passing through opening 46 to the bottom of base 22. Electrical connection 44a is the signal lead of switch 42 with connection 44b connected to keyboard electrical ground 45. Switch 42 serves to generate a key switch on/off discrete and is normally open (key off) when key 20 is in its rest position. When the performer depresses the front end of key 20 approximately ¼ inch in the direction of arrow 48, switch 42 is closed (key on). At an equivalent displacement in an acoustic piano action, the hammer leaves the escapement to strike the string and thereby sounds a note. Since washer 40 is compressible, key 20 can be depressed an additional 3/16 inch compressing washer 40 and sustaining the closure of switch 42. At its fully depressed position, the total travel of key 20 is limited to 7/16 inch which is substantially equal to the maximum displacement of a conventional piano key.

Weighted inserts 50a and 50b are pressed into cylindrical wells at the rearward end of key 20. This serves to provide a restoring force of 1.5–2.0 oz. at the point of performer input indicated by arrow 48. This force is approximately equal to the static imbalance in an acoustic piano action and is sufficient to quickly return key 20 to its rest position. As key 20 moves upward switch 42 is reopened (key off) when key 20 is approximately ¼ inch from the rest position.

There is an encased motor 52 mounted in a cylindrical hole in base 22 such that motor shaft 54 is pointed upward toward the rearward end of key 20. The rotational axis of shaft 54 is substantially orthogonal to base 22 and intersects the longitudinal axis of key 20. Motor 52 may be a DC permanent magnet type, for example, with a basket wound ironless rotor. Such motors are common in tape and camera drives and are characterized by low friction, rotor inertia and armature inductance. A torque results at shaft 54 when a current passes through motor terminals 55a and 55b. The electrical interface to motor 52 consists of motor leads 56a and 56b connected to motor terminals 55a and 55b respectively.

There is a spool drive assembly 58 which serves to transmit a motor shaft 54 torque to key 20 such that a rotation of shaft 54 will cause a rotation of key 20 within the limits of key angular travel. A positive voltage applied across motor leads 56 (56a HI and 56b LO) will induce a positive motor current and counterclockwise motion of key 20.

Spool drive assembly 58 is comprised of spool 60, front and rear cables 62 and 64, cable tensioner 66, front and rear cable pins 68 and 70, front and rear pulleys 72 and 74, and front and rear pulley supports 76 and 78. Spool 60 may be made of a rubber, for example, and is pressed onto shaft 54. Rear cable 64 which is preferably made of braided nylon, is wound around spool 60 in a counterclockwise direction extending toward cable tensioner 66 in a forward direction and toward rear pulley 74 in a rearward direction.

Rear pulley support 74 is secured to base 22 between motor 52 and rear rail 30 and serves to support and locate rear pulley 74. Pulley 74 is mounted such that its axis of rotation is collinear with the rotational axis of key 20. Pulley 74 receives rear cable 64 from spool 60 and is located to maintain that portion of cable 64 substantially parallel with base 22 and in line with the longitudinal centerline of key 20. Pulley 74 is further located such that cable 64 exits pulley 74 in a direction approximately perpendicular to base 22 and in line with rear cable pin 70. Cable pin 70 receives cable 64 through opening 82 in key 20 above rear pulley 74. Pin 70 is pressed into key 20 between weights 50*a* and 50*b* and serves to secure the rearward end of cable 64 at a point along the longitudinal axis of key 20 and at a distance L from the rotational axis of key 20. The distance L and the spool radius are important dimensions since their ratio defines the mechanical advantage of the spool drive assembly 58. The forward portion of cable 64 passes through opening 84 in balance rail 24 and is secured to the rearward end of cable tensioner 66.

Front pulley support 76 is secured to base 22 between front rail 38 and balance rail 24 and serves to support and locate front pulley 72. Pulley 72 is mounted such that its axis of rotation is collinear with the rotational axis of key 20. The rearward end of front cable 62 is secured to the forward end of tensioner 66 and is received by pulley 72. Pulley 72 is located to maintain that portion of cable 62 substantially parallel to base 22 and in line with the longitudinal centerline of key 20. Pulley 72 is further located such that cable 62 exits pulley 72 in a direction perpendicular to base 22 and in line with front cable pin 68.

Cable pin 68 receives cable 62 through opening 80 in key 20 above front pulley 72. Pin 68 is pressed into the forward portion of key 20 and serves to secure the forward end of cable 62 at a point along the longitudinal axis of key 20 and at a distance L from the rotational axis of key 20.

Cable tensioner 66 may be a coil spring, for example, and serves to maintain tension in cables 62 and 64 such that there is no slip between cable 64 and spool 60 within the torquing capability of motor 52. Since cable pins 68 and 70 are equidistant from fulcrum 29, tensioner 66 exerts no net torque on key 20. Cable tensioner 66 does, however, exert a net force on blade 26 which serves to maintain a positive contact between the blade and vee block 28 for the range of anticipated performer inputs and motor torques. Finally, since the cable force is statically balanced at the spool, there is only a very small overturning moment exerted on motor shaft 54.

DETAILED DESCRIPTION—SINGLE CABLE EMBODIMENT

Figure 2:
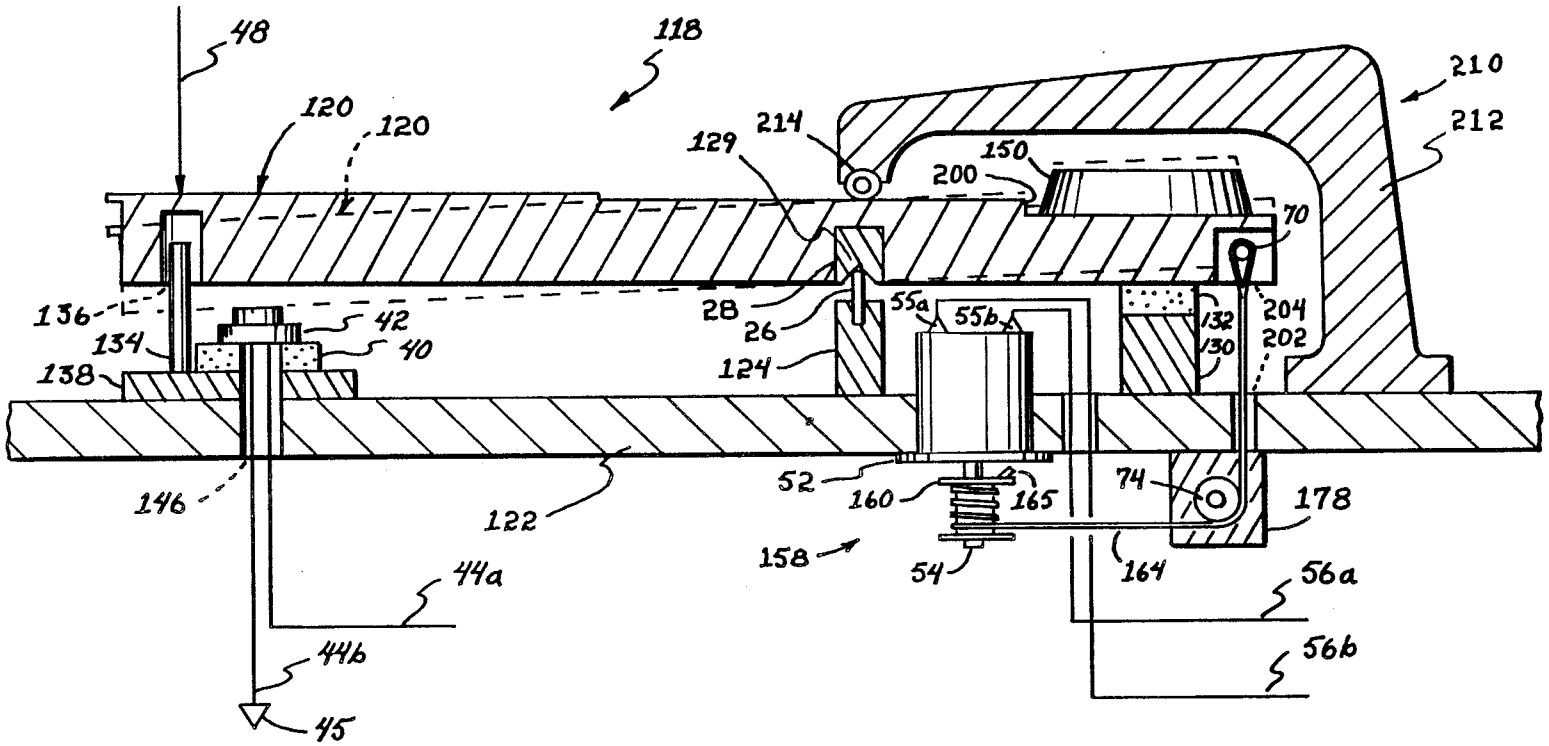
FIG. 2 is a diagrammatic, side elevational view of the keyboard according to another embodiment of the present invention showing the key in its rest position in solid line and in a partially depressed position in dotted line.

FIG. 2 is a diagrammatic, side elevational view of a keyboard 118 according to another embodiment of the present invention which comprises a plurality of playing keys 120 arranged as keys 20 in the preceding embodiment. Playing key 120 is shown in its rest position in solid line and in a partially depressed position in dotted line.

Playing keys 120 are supported on a base structure 122 by a key balance rail 124 secured to base 122 near the rearward end of key 120. A blade 26 protruding from balance rail 124 fits into a vee block 28 which is pressed into a recess in key 120. Blade 26 and vee block 28 serve as a fulcrum 129 for key 120 and constrain side-to-side motion of key 120. A rear rail 130 is secured to base 122 and a rear cushioning washer 132 which rests on top of rail 130, serves to limit the clockwise travel of key 120.

A front rail 138 which is secured to base 122, a front cushioning washer 40 which rests on top of rail 138 and an electrical switch 42 which is secured to washer 40 serve to limit the counterclockwise motion of key 120. Electrical connections 44 pass through opening 146. The electrical interface and actuation of switch 42 are the same as for the preceding embodiment.

A guidepin 134 which protrudes from front rail 138 is received within an opening 136 within the center portion of key 120 and serves to further constrain the side-to-side motion of key 120.

The rearward end of key 120 has a rabbet 200 cut therein, and a weight 150 supported thereon. Weight 150 serves to imbalance key 120 about fulcrum 129. The performer must apply a 1.5–2.0 oz. force input to key 120 at the point and in the direction of arrow 48 to overcome this imbalance. Weight 150 thereby simulates the static imbalance of an acoustic piano action as previously described.

There is an encased motor 52 mounted in a cylindrical hole in base 122 such that motor shaft 54 is in an inverted orientation from the embodiment of FIG. 1. Motor terminals 55*a* and 55*b* are connected to motor leads 56*b* and 56*a* respectively (reverse phased from FIG. 1 embodiment).

A flanged spool drive assembly 158 serves to unilaterally transmit a motor shaft 54 torque to key 120 so that a counterclockwise rotation of shaft 54 will cause a clockwise rotation of key 120. Until limited by rear cushioning washer 132, such motion is induced when a negative voltage is applied across motor leads 56 (56*a* HI, 56*b* LO).

Flanged spool drive assembly 158 is comprised of a flanged spool 160, cable 164, cable pin 70, pulley 74 and pulley support 178. Flanged spool 160 is cylindrical in shape with flanges at each end and is pressed onto motor shaft 54. Spool 160 may be made of a metal or plastic. Cable 164 which is preferably made of braided nylon is secured at one end to the upper flange of spool 160. Wound clockwise about spool 160, cable 164 exits spool 160 near the bottom flange in a rearward direction.

Pulley support 178 is secured to base 122 and serves to support and locate pulley 74. Pulley 74 is mounted such that its axis of rotation is collinear with the rotational axis of key 120. Pulley 74 receives cable 164 from spool 160 and is located to maintain that portion of cable 164 substantially parallel with base 122 and in line with the longitudinal centerline of key 120. Pulley 74 is further located such that cable 164 exits pulley 74 in a direction approximately perpendicular to base 122 and in line with cable pin 70.

Cable pin 70 receives cable 164 through opening 202 in base 122 and opening 204 in key 120. Pin 70 is pressed into key 120 and serves to secure the rearward end of cable 164 at a point along the longitudinal axis of key 120 as in the embodiment of FIG. 1.

Since motor torques can be transmitted in only one direction by spool drive 158, a small negative bias voltage must be maintained across electrical connections 56 to maintain tension in cable 164. If this voltage is removed (e.g., power off condition) and cable 164 slackens, the bottom flange of spool 160 will serve to prevent cable 164 from overrunning spool 160.

A key retainer assembly 210 serves to maintain a positive contact between blade 26 and vee block 28 for the range of anticipated performer inputs and motor torques, and to provide a small restoring torque to overcome key 120 friction torques as key 120 returns to its rest position. Key retainer assembly consists of key retainer bracket 212 and flexible strip 214. Retainer bracket 212 has an inverted L-shaped cross section, is secured at its lower end to base 122 and extends laterally the width of keyboard 118. Retainer 212 serves to locate flexible strip 214 above keys 120. Strip 214 is tubular and made of a compliant material such as rubber. The upper portion of strip 214 fits in a recess in the overhanging end of bracket 212, while the lower portion contacts key 120 at a point slightly rearward of fulcrum 129. Bracket 212 holds strip 214 in compression thereby exerting a downward force on supporting blade 26 and a small clockwise torque on key 120.

Although there are many other possible embodiments for the key operating apparatus of the present invention, the dual cable embodiment of FIG. 1 will be assumed for the remainder of this specification. This should not be construed as a limitation on the scope of the invention, but rather as an exemplification of one preferred embodiment thereof.

DETAILED DESCRIPTION—EQUATIONS OF MOTION

Figure 3:
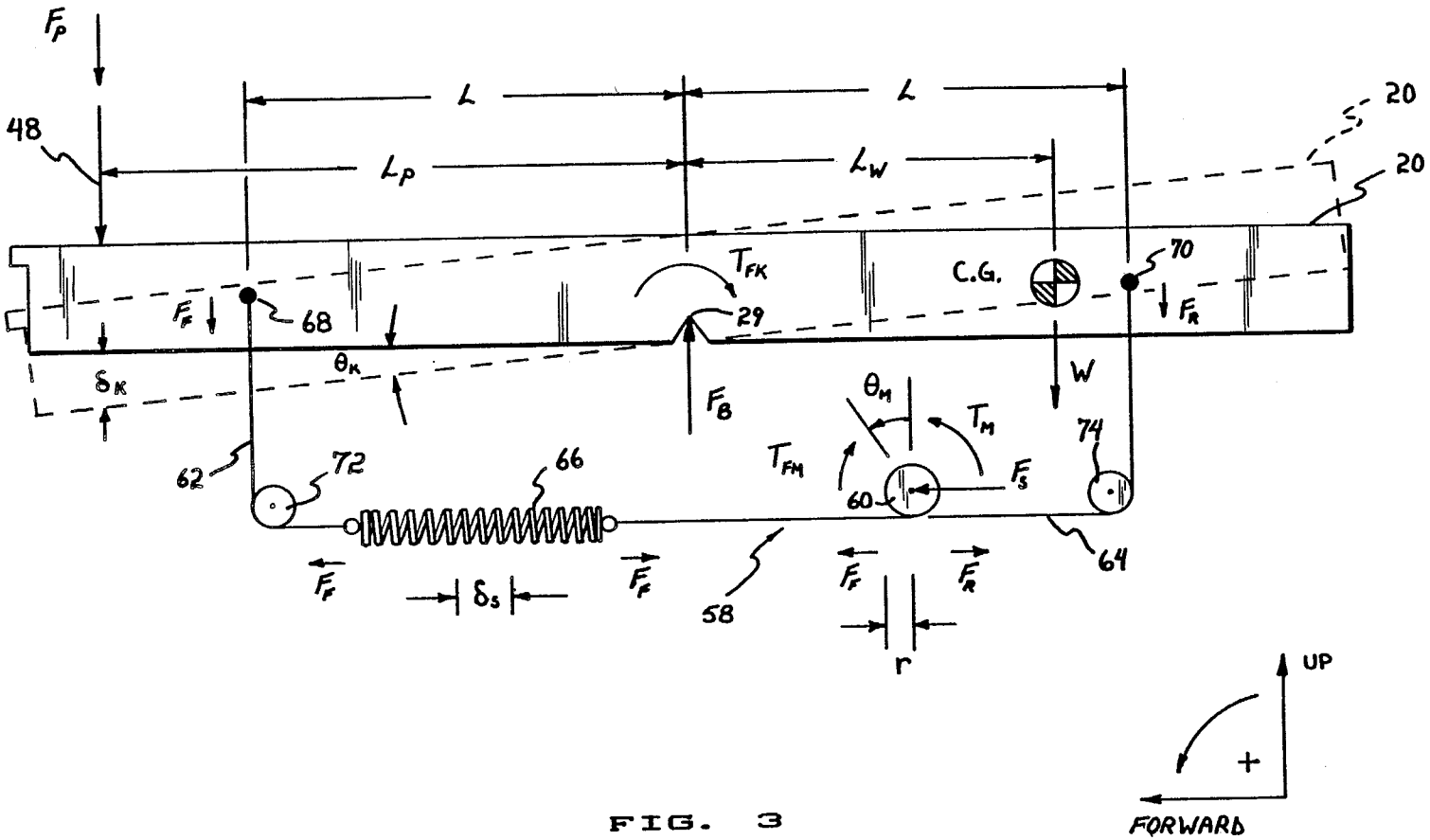
FIG. 3 is a free-body diagram of an embodiment of the present invention showing the mathematical symbols, dimensions and parameters necessary for the derivation of the equations of motion of the key.

Equations of motion for the dual cable embodiment will now be derived to support the subsequent discussion of its operation. FIG. 3 is a free-body diagram of a keyboard 18 that shows the mathematical symbols, dimensions and parameters necessary for the derivation of the equations that govern the relevant static and dynamic behavior of a spool driven key.

Referring to FIGS. 1 and 3, weighted inserts 50*a* and 50*b* cause the center of gravity (C.G.) of playing key 20 to be located at the rearward end of key 20 a distance $L_W$ from fulcrum 29. The weight W of key 20 acts through the C.G. to provide a restoring force of 1.5–2.0 oz. as sensed at the performer's input indicated by arrow 48. The performer in turn applies a counteracting force $F_P$ in the direction of arrow 48 at a distance $L_P$ from fulcrum 19. Key 20 is also acted on by front and rear cable forces $F_F$ and $F_R$ through moment arm L, supporting blade force $F_B$ and frictional torque $T_{FK}$. The frictional torque is assumed to be coulombic given by, $$T_{FK}=T_{FK}'*\mathrm{sgn}(\Omega_K) \quad [1]$$

where, $T_{FK}'$ ≡ magnitude of a lumped frictional torque including the friction in the contact of blade 26 with vee block 28 and the reflected friction of pulleys 72 and 74, $\Omega_K$ ≡ angular velocity of key 10.

The sum of the torques $\Sigma T_K$ about fulcrum 29 is therefore:

$$\Sigma T_K=F_F*L-F_R*L-W*L_W-T_{FK}+F_p*L_p \quad [2]$$

The sum of forces $\Sigma F_K$ acting through fulcrum 29 is:

$$\Sigma F_K=-F_F-F_R-W-F_p+F_P \quad [3]$$

Cable tensioner 66 maintains a tension $F_F$ in front cable 62 and the forward portion of rear cable 64 equal to the product of a spring constant $K_s$ and half the displacement $\delta_s$ of tensioner 66 from its unextended length:

$$F_F=K_s*(\delta_K/2) \quad [4]$$

It is assumed that tension $F_F$ is sufficient to prevent slippage between cable 64 and spool 60 within the torquing capability of motor 52.

For the purpose of illustration spool 60 is shown in FIG. 3 in a horizontal orientation with a radius r. Spool 60 is acted on by cable forces $F_F$ and $F_R$, motor 52 torque $T_M$, base 22 supporting force $F_s$, and motor 52 frictional torque $T_{FM}$. Motor friction is also assumed to be coulombic given by, $$T_{FM}=T_{FM}'*\mathrm{sgn}(\Omega_M) \quad [5]$$

where, $T_{FM}'$ ≡ magnitude of motor 52 frictional torque, $\Omega_M$ ≡ angular velocity of motor shaft 54.

Cable 64 is wound counterclockwise on spool 60 such that a positive angular displacement $\theta_M$ of motor shaft 54 will result in a positive angular displacement $\theta_K$ of key 20 within the limits of its angular freedom. Accordingly, $$\theta_M=n*\theta_K \quad [6]$$

where n is the ratio of moment arm L to spool radius r:

$$n=L/r \quad [7]$$

By EQN.[6], the motor frictional torque can be alternatively expressed as:

$$T_{FM}=T_{FM}'*\mathrm{sgn}(\Omega_K) \quad [8]$$

The sum of the torques $\Sigma T_M$ about motor shaft 54 is:

$$\Sigma T_M=-F_F*r+F_R*r-T_{FM}+T_M \quad [9]$$

The sum of forces $\Sigma F_M$ acting through the center of shaft 54 is:

$$\Sigma F_M=F_F-F_R+F_s \quad [10]$$

Assuming the rotational inertia of pulleys 72 and 74 is small compared to the inertia of either key 20 or the combined motor 52 rotor and spool 60 inertia, FIG. 3 can be considered as two rigid bodies governed by the following four equations, $$\Sigma T_K = J_K * \frac{d}{dt}(\Omega_K) \quad [11]$$

$$\Sigma F_K = 0 \quad [12]$$

$$\Sigma T_M = J_M * \frac{d}{dt}(\Omega_M) \quad [13]$$

$$\Sigma F_M = 0 \quad [14]$$

where, $J_K$ ≡ rotational inertia of key 20 about fulcrum 29, $J_M$ ≡ rotational inertia of motor 52 rotor and spool 60 about the axis of rotation of shaft 54.

Combining EQNS. [1], [2], [6], [8], [9], [11]and [13], the rotational dynamics of key 20 and spool drive assembly 58 can be expressed as, $$F_P * L_P + n * T_M - W * L_W - T_{FE} = J_{KE} * \frac{d}{dt}(\Omega_K) \quad [15]$$

where $T_{FE}$ and $J_{KE}$ are the combined key and motor friction and inertia reflected to fulcrum 29 through drive ratio n:

$$T_{FE}=T_{FE}'*\mathrm{sgn}(\Omega_K) \quad [16]$$

$$J_{KE}=J_K+N^2*J_M \quad [17]$$

where, $$T_{FE}' \equiv T_{FK} + n * T_{FM} \quad [18]$$

The rotational equations of motion for a spool driven key are therefore given by:

$$\frac{d}{dt}(\theta_K) = \Omega_K \quad [19]$$

$$\frac{d}{dt}(\Omega_K) = \frac{1}{J_K} * [F_P * L_P + n * T_M - W * L_W - T_{FE}] \quad [20]$$

Since the angular freedom of key 20 is small (<3.0 degrees in a conventional piano action) the linear displacement $\delta_K$ *and velocity* $v_K$ of key 20 along the direction of arrow 48 are:

$$\delta_K = L_P * \theta_K \quad [21]$$

$$v_K = L_P * \Omega_K \quad [22]$$

It follows from EQN. [20] that the performer's applied force must balance the weight of key 10 and motor torque at equilibrium, $$F_P' = (L_W/L_P) * W - (n/L_P) * T_M' \quad [23]$$

where $F_p'$ and $T_M'$ are the steady state applied force and motor torque. In this manner the static imbalance of key 20 can by varied by controlling the static output torque of motor 52.

The static load $F_s'$ on blade 26 and static load $F_s'$ on motor 52 are then, $$F_g' = K_s * \delta_K + \frac{(L_P + L_W)}{L_P} * W + \frac{(L_P + L)}{r} * T_M \quad [24]$$

$$F_g' = -(1/r) * T_M \quad [25]$$

EQNS. [24]and [25]express the a fundamental property of the dual cable spool drive: cable tensioner 66 exerts the total spring force ($K_s * \delta_K$) on fulcrum 29 while exerting no net force on the motor 52 or net torque on key 20. This spring force serves to maintain positive contact between blade 26 and vee block 28 and supplies sufficient cable tension to prevent cable slip on spool 60.

To develop equations for the control of output motor torque $T_M$, it will be assumed that motor 52 is a DC permanent magnet type. Accordingly, a torque $T_M$ results at shaft 54 proportional to the armature current $I_M$, $$T_M = K_T * I_M \quad [26]$$

where $K_t$ is the motor torque constant. For a motor voltage $V_M$ applied across motor electrical connections **56*a* and 56*b***, the motor current $I_M$ is given by the following differential equation, $$V_M = R_M * I_M + L_M * \frac{d}{dt}(I_M) + V_g \quad [27]$$

where, $R_M \equiv$ motor armature resistance, $L_M \equiv$ motor armature inductance, $V_s \equiv$ motor back EMF.

The back EMF $V_s$ is proportional to the angular velocity of the motor shaft, $$V_s = K_s * \Omega_M \quad [28]$$

where $K_s$ is the motor back EMF constant.

If it is further assumed that motor 52 has a basket wound ironless rotor, inductive effects are minimal ($L_M \approx O$) and to good approximation EQN. [27] can be simplified:

$$V_M = R_M * I_M + V_s \quad [29]$$

DC motors are conventionally controlled by either a voltage or current amplifier. For voltage control, the motor voltage is varied in proportion to a motor control command $u_c$, $$V_M = K_v * u_c \quad [30]$$

where Kv is the voltage amplifier gain. For current control, the current through the armature is varied in proportion to $u_c$, $$I_M = K_c * u_c \quad [31]$$

For the preferred embodiment, current control is desirable since motor torque can be commanded directly. That is by EQN. [26] it follows that:

$$T_M = K_c * K_T * u_c \quad [32]$$

To complete a mathematical description of keyboard 18, the state of the key switch on/off discrete is defined in terms of the linear displacement $\delta_K$ of key 20, $$\text{key switch on/off} = \begin{cases} 0, & 0 \text{ inch} \leqq \delta_K \leqq \tfrac{1}{4} \text{ inch} \\ 1, & \tfrac{1}{4} \text{ inch} < \delta_K \leqq 7/16 \text{ inch} \end{cases} \quad [33]$$

where 0 is interpreted as "key off" and 1denotes "key on". EQN. [33]simulates sonic initiation in a conventional piano action where similar displacements cause the sounding of a note.

OPERATION—CONTROLLER KEYBOARD SYSTEM

The present invention may be incorporated with a variety of keyboard electronic instruments. For the convenience of description, however, the presentation of its operational features will be limited to a class of instruments called controller keyboards.

A controller keyboard is comprised of a plurality of conventionally arranged playing keys. Although there is generally a provision for the performer to adjust various parameters and to select modes of operation, the keyboard controller has no sound generating capability of its own. Instead it controls one or more musical tone generators, synthesizers, or electronic keyboards by means of a common digital interface. The outputs of these devices can then be mixed and amplified in the usual manner to produce a musical output. Unlike early electronic keyboards with built-in sound generation and no interface provisions, the controller keyboard allows the performer to play many electronic instruments from a single master keyboard.

Figure 4:
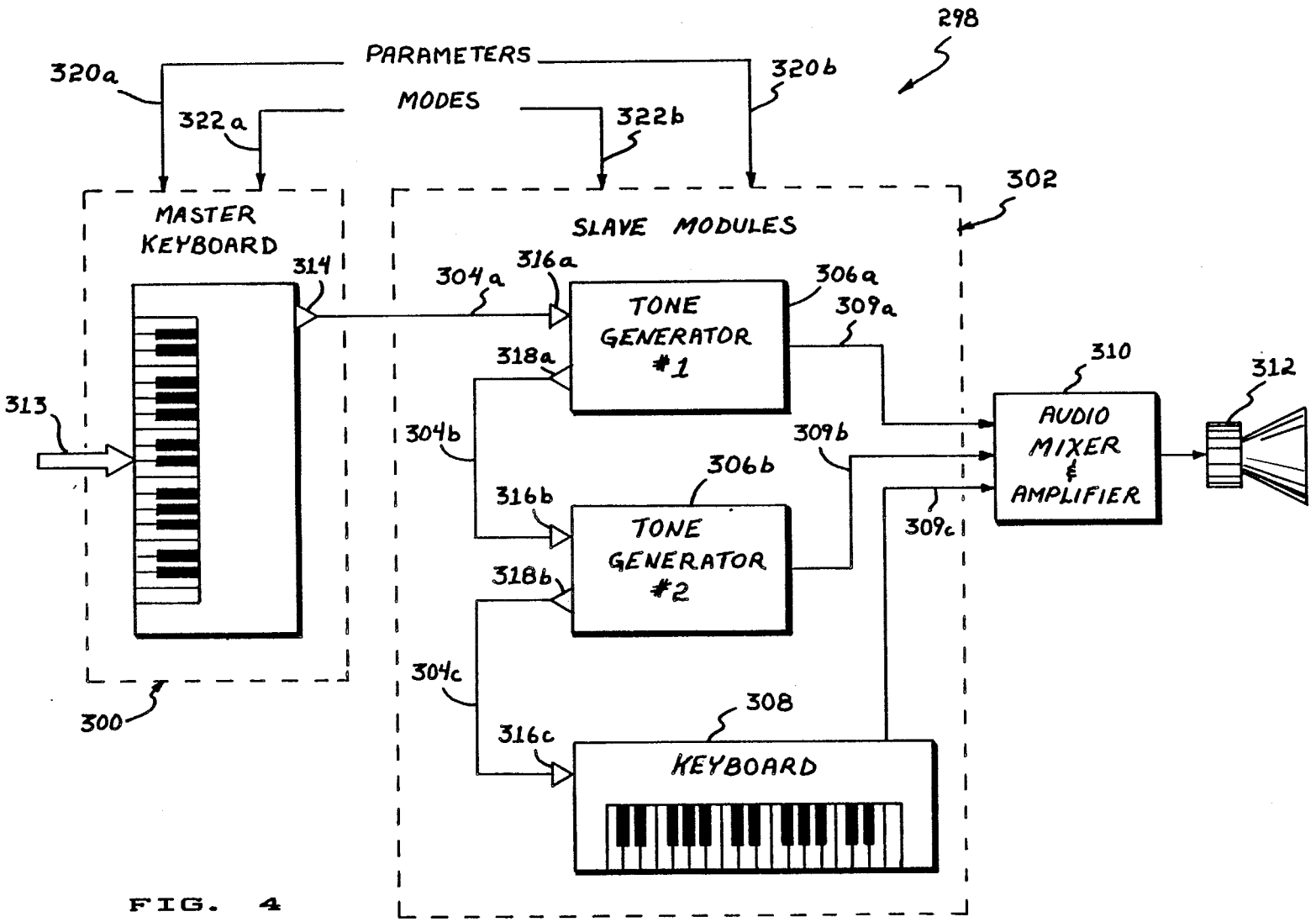
FIG. 4 is a block diagram representation of a controller keyboard system.

FIG. 4 is a block diagram representation of a controller keyboard system 298, where controller keyboard 300 behaves as the master control for slave modules 302 interconnected through MIDI interface **304*a*, 304*b* and 304*c*. MIDI is the acronym for Musical Instrument Digital Interface developed by the International MIDI Association to serve as the standard interface for musical instruments. For this example the slave modules consist of tone generators 306***a* and 306*b* and electronic keyboard 308. The outputs 309*a*, 309*b* and 309*c* of slave modules 302 are combined by audio mixer and amplifier 310 to drive speaker 312. Each MIDI-equipped instrument contains a transmitter and/or receiver. In FIG. 4, controller keyboard 300 transmits messages in MIDI format through MIDI OUT port 314 in response to a performer musical input 313. Tone generators 306*a* and 306*b* and keyboard 308 receive these messages through MIDI IN ports 316*a*, 316*b* and 316*c* respectively, and execute MIDI commands. MIDI THRU ports 318a and 318*b* serve to pass the transmitted messages from master keyboard 300 to modules 306*b* and 308.

Controller keyboard system 298 is very flexible; the performer can tailor its response by the adjustment of parameters 320*a* and 320*b*, and selection of operational modes 322*a* and 322*b* prior to or while playing master keyboard 300.

These parameters and modes fall into four categories:

(1) TOUCH RESPONSE—the parameters that control touch response are available for adjustment in master keyboard 300. In a state of the art controller these might include velocity and aftertouch sensitivity. The present invention provides an expanded set, allowing adjustment of both tactile response and dynamic control of played notes. There are also special modes to simulate the touch response of percussive as well as conventional keyboard instruments.

(2) MIDI—the routing of note on/off data from master keyboard 300 to the sound generating elements or voices of slave modules 302 is controlled by MIDI mode and a MIDI channel number parameter. Usually the transmitter and receiver(s) are set up in the same mode. The relationship between MIDI channel numbers and the slave module's voice assignment is specified by the performer.

(3) SONIC—the parameters that influence the sonic characteristics of each voice are available for adjustment in slave modules 302. These parameters depend on the method of tone generation (e.g., analog or digital syntheiss, sampling) and determine the sound quality and harmonic content of the generated note. (4) SPECIAL—manufacturers usually provide parameters and modes that relate to unique features of their musical instrument. For example, in some controllers the keyboard can be partitioned into user-programmable zones that can be assigned their own MIDI channel number, velocity or pressure sensitivity. In The present invention there is an offset parameter to simulate the intervallic tonal response of a bell.

Although a detailed discussion of all of the above parameters and modes is beyond the scope of this specification, the following example will highlight the aspects of the master/slave operation of controller keyboard system 298 necessary to support subsequent description of the present invention.

As a note is played, controller 300 transmits a MIDI channel number, key state (MIDI_KEY_ON), key number (MIDI_KEY, i.e. fundamental frequency of the played key) and key velocity (MIDI_VELOCITY). Each slave has an assigned MIDI channel number and responds to received MIDI messages according to channel number, MIDI mode and a programmed sonic response. For example, suppose tone generator 306*a* has been programmed to respond as an acoustic piano. When the MIDI_KEY_ON command (note on) is acknowledged by slave 306*a*, it generates a tone of the proper pitch with a piano-like timbre. After the tone is initiated its dynamics (e.g., loudness), are controlled by the initial key velocity given by the MIDI_VELOCITY message. This is analogous to a conventional piano action where the loudness of a note is influenced by the hammer velocity as it strikes the string. When MIDI_KEY_ON changes state (note off), the key release velocity is given in a second MIDI_VELOCITY message to control the decay and duration of the tone approximating the dampened response of a vibrating string.

OPERATION—CONTROLLER KEYBOARD

Figure 5:
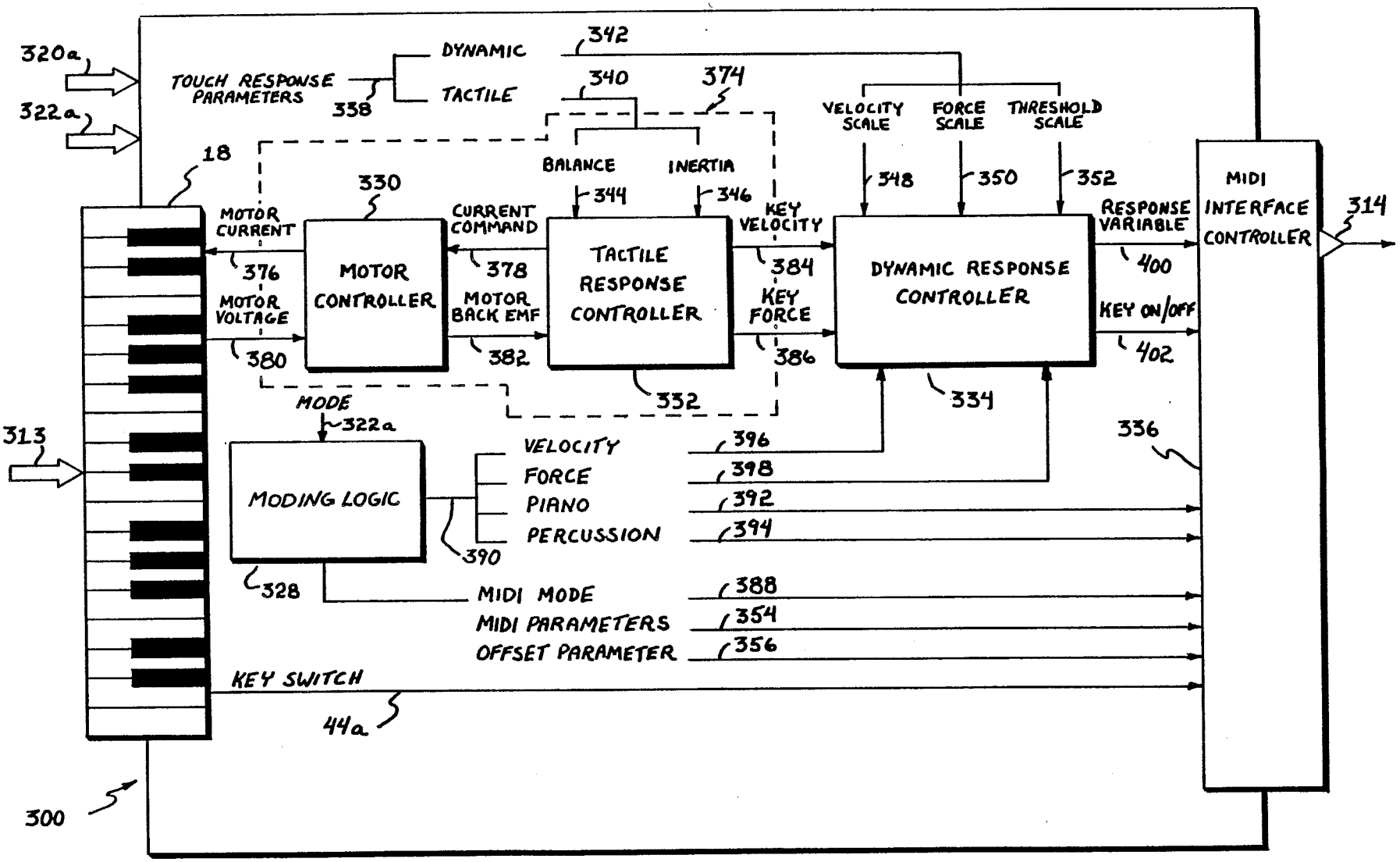
FIG. 5 is a block diagram representation of a controller keyboard according to an embodiment of the present invention.

FIG. 5 is functional block diagram of the present invention configured as a controller keyboard with a MIDI interface. Controller keyboard 300 is comprised of keyboard 18, moding logic 328 motor controller 330, tactile response controller 332, dynamic response controller 334 and MIDI interface controller 336. Moding logic 328 and controllers 330, 332, 334 and 336 provide the necessary processing of performer inputs, keyboard and MIDI data to control the touch response of keyboard 18 and to provide master control of slave modules 302 via MIDI OUT port 314.

The above processing may be implemented with various combinations of analog and digital electronics common to keyboard electronic instruments and is not limited to any specific mechanization. The interface with keyboard 18 is analog in nature since a currents and voltages are controlled and monitored in DC motor 52. The MIDI interface is digital with a standard protocol for the transmission of MIDI data. The performer interface might utilize function switches and a keypad data entry scheme for the selection of operational modes 322*a* and adjustment of system parameters 320*a*. Since the mechanization of these interfaces is not unique, the present specification describes the functional operation of each controller without direct reference to data input, data output or data processing technique.

The performer adjusts parameters 320*a* to tailor the response characteristics of controller keyboard 300. Touch response parameters 338 are subdivided into tactile parameters 340 input to tactile response controller 332, and dynamic parameters 342 input to dynamic response controller 334. MIDI parameters 354 and offset parameter 356 are input to MIDI parameters 354 and offset parameter 356 are input to MIDI Interface Controller 336. These parameters are defined as follows:

Tactile Parameters

344, BALANCE—The effective imbalance of playing keys 20 of keyboard 18 can be varied with balance parameter 344.

346, INERTIA—The effective inertia of playing keys 20 of keyboard 18 can be varied with inertia parameter 346.

Dynamic Parameters

348, VELOCITY SCALE—The velocity sensitivity of keyboard 18 is determined by velocity scale parameter 348.

350, FORCE SCALE—The force sensitivity of keyboard 18 is determined by force scale parameter 350.

352, THRESHOLD SCALE—The key state (note on/off) can be determined by either electrical switch 42 of keyboard 18 or by velocity and force thresholds.

Threshold scale parameter 352 determines the threshold sensitivity.

MIDI Parameters

354, MIDI—MIDI parameters 354 (e.g., transmitter channel number) are a standard set defined by MIDI Specification 1.0 of the International MIDI Association.

Special Parameters

356, OFFSET—In a MIDI system each key is assigned an integral key number (MIDI_*KEY*) *which defines its fundamental pitch. The present invention allows the normal pitch assignment to be raised or lowered an integral value with offset parameter* 356.

A feedback control system 374 comprises of keyboard 18, motor controller 330 and tactile response controller 332, serves to control the effective imbalance and inertia of key 20 to the levels specified by the performer through adjustment of tactile parameters 340. In system 374, motor 52 serves as both a torque (control) effector and velocity (feedback) sensor. The torque output is proportional to motor current 376 regulated by motor controller 330 in response to current commands 378 from tactile response controller 332. The DC component of motor current 376 determines effective key imbalance or static force; the AC component, the effective inertial or dynamic force. Motor controller 330 senses motor voltage 380 and motor current 376 to develop an estimate of motor back EMF 382. Tactile response controller 332 computes an estimate of key velocity 384 from motor back EMF 382. The time derivative of key velocity 384 scaled by inertia parameter 346 in combination with balance parameter 344, determine current command 378. The time derivative of key velocity is also used to compute and estimate of net key force 386. Key velocity 384 and key net force 386 are in turn input to dynamic response controller 334.

The performer selects modes 322*a* to determine desired controller keyboard operation. Moding logic 328 processes operational modes 322*a* to develop MIDI mode 388 (defined in aforementioned MIDI Specification 1.0), and to enable one of six possible touch response modes through the activation/deactivation of four touch response mode states 390. PIANO mode state 392 and PERCUSSION mode state 394 are input to MIDI interface controller 336 VELOCITY mode state 396 and FORCE mode state 398 are input to dynamic response controller 334. VELOCITY and FORCE mode states are mutually exclusive; i.e., activation of VELOCITY deactivates FORCE and vice versa. States 390 are defined as follows:

Touch Response Mode States

392, PIANO—When PIANO state 392 is active, note on/off is determined by the closure/opening of electrical switch 42.

394, PERCUSSION—When PERCUSSION state 394 is active, note on/off is determined by velocity and force thresholds.

396, VELOCITY—When VELOCITY state 396 is active, response variable 400 is proportional to the magnitude of key velocity near the instant of note on and note off transitions. Accordingly, response variable 400 is set equal to the absolute value of key velocity 384 scaled by velocity scale parameter 348.

398, FORCE—When the FORCE state 398 is active, response variable 400 is proportional to the magnitude of the net forces acting on key 20 near the instant of note on and note off transitions. Accordingly, response variable 400 is set equal to the absolute value of key net force 386 scaled by force scale parameter 350.

Dynamic response controller 334 and MIDI interface controller 336 process key switch on/off discrete 44*a*, key velocity estimate 384, key net force estimate 386, dynamic parameters 342, touch response mode states 390 and MIDI modes 388 to provide the six touch response modes. Selection of MIDI mode 358 and the adjustment of parameters 320*a* is allowed in any of the touch response modes. These modes are:

Touch Response Modes

MODE_1—(PIANO on, PERCUSSION off, VELOCITY on)

When $MODE_{13}$ 1 is enabled the dynamic response of controller keyboard 300 is similar to a state of the art keyboard controller. Note on/off is controlled by electrical switch 42 and the transmitted MIDI_VELOCITY message is equal to a scaled value of key velocity given by response variable 400. A MIDI transmission occurs when key 20 engages switch 42 (note on) and again when key 20 is released (note off). In this mode, balance parameter 344 and inertia parameter 346 can be set to simulate a pinao action or a light organ touch.

MODE_2—(PIANO off, PERCUSSION on, FORCE on)

The keyboard under MODE_2 control has a percussive response similar to striking a drum or bell. To simulate a percussive feel, balance parameter 344 is adjusted to make the key action very stiff (e.g., an effective imbalance three or four times greater than a piano action). In this mode, note on/off is determined by the performer's attack/release dynamics and requires only a small key depression to sound a note. Furthermore, tone generation is controlled by the net force acting on the key instead of key velocity. Key on/off discrete 402 controls MIDI transmissions. When the performer's input 313 exceeds an attack velocity/force threshold, discrete 402 is set and a note on MIDI transmission occurs. The MIDI_VELOCITY message is assigned a scaled value of net key force given by response variable 400. If performer input 313 remains below a release velocity/force threshold for a fixed time interval, discrete 402 is reset and a note off MIDI transmission occurs. The second MIDI_VELOCITY message is also assigned the value of scaled response variable 400.

MODE_3—(PIANO on, PERCUSSION on, FORCE on)

MODE_3 is percussive mode that simulates the intervallic tonal response of a bell by allowing two notes to be sounded with a single key stroke. Initially MODE_3 is identical to MODE_2, and the first note is controlled by the performer's attack dynamics. If the performer does not release but further depresses the key to engage switch 42, a second note will occur. The first note is assigned the normal key number or fundamental pitch. The second note can be assigned an equal, higher or lower pitch as determined by the value and sign of offset parameter 356. If, for example, the first note were middle C (MIDI_KEY=60) and the second note were raised to E (OFFSET=+4, MIDI_KEY=64), the performer would hear an arpeggiated major third as he played the key. In this mode the dynamics of both notes are controlled by net key force.

MODE_4—(PIANO on, PERCUSSION off, FORCE on)

MODE_4 is a variation of piano MODE_1 where response variable 400 is scaled net key force instead of key velocity.

MODE_5—(PIANO off, PERCUSSION on, VELOCITY on)

MODE_5 is a variation of percussive MODE_2 where response variable 400 is scaled key velocity instead of net key force.

MODE_6—(PIANO on, PERCUSSION on, VELOCITY on)

MODE_6 is a variation of percussive MODE_3 where response variable 400 is key velocity instead of net key force. At power on or in the event that neither the PIANO or PERCUSSION state are active, controller keyboard 300 defaults to MODE_1.

OPERATION—KEYBOARD

Figure 6:
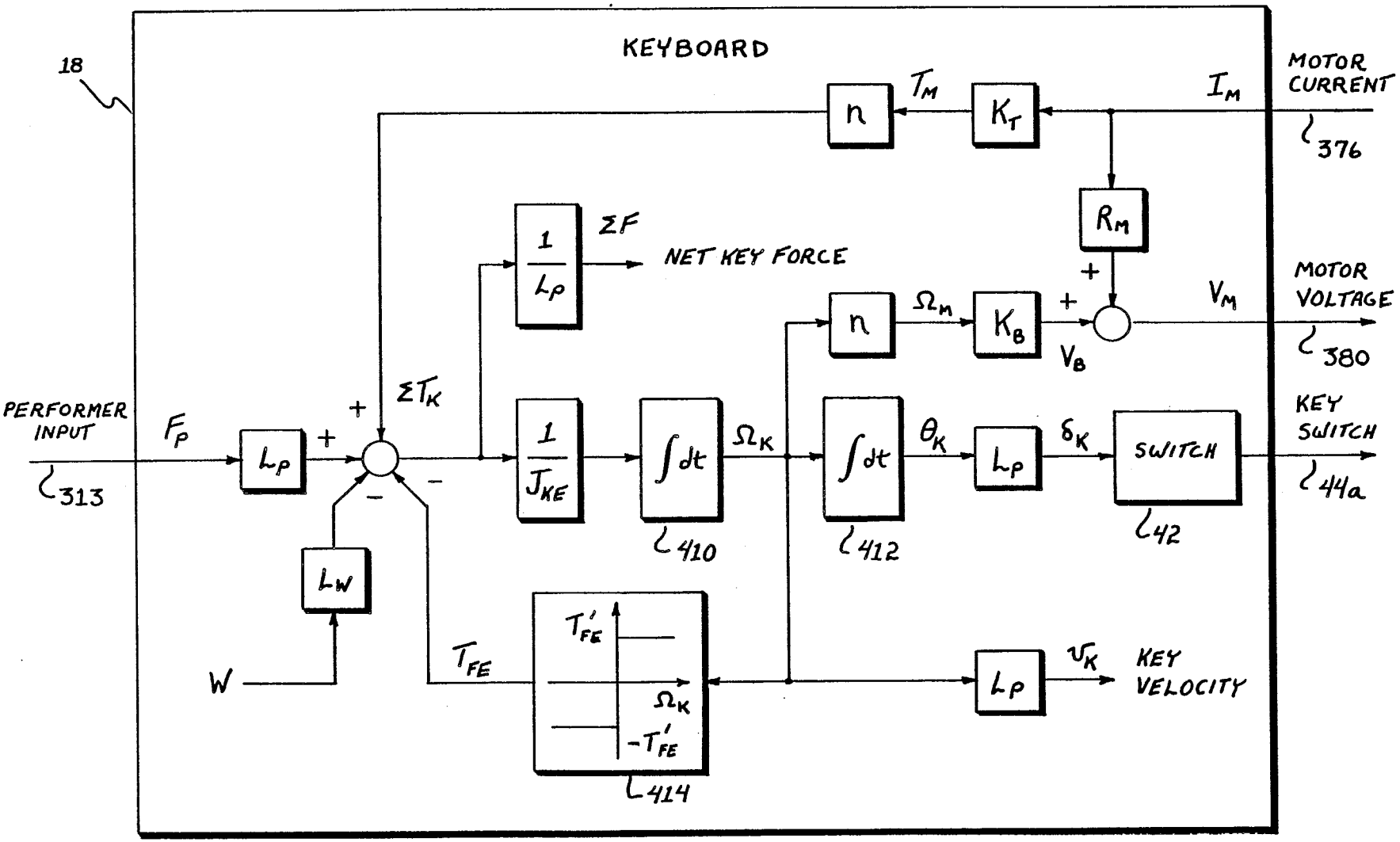
FIG. 6 is a block diagram representation of a keyboard according to an embodiment of the present invention.

FIG. 6 is a functional block diagram of keyboard 18 which forms a part of controller keyboard 300. The inputs to keyboard 18 are performer's applied force 313 and motor current 376; the outputs are motor voltage 380 and key switch on/off discrete 44a. The relationship between inputs and outputs is given in the previously derived equations of motion, represented diagrammatically in FIG. 6.

The input torques exerted on playing key 18 about fulcrum 29 are the performer's applied force $F_P$ acting through moment arm $L_P$ and motor torque $T_M$ multiplies by drive ratio n. These input torque are counteracted by equivalent friction torque $T_{FE}$ and key weight W acting through moment arm $L_W$. The sum of these torques $\Sigma T_K$ accelerates key 20 proportional to the inverse of equivalent key inertia $J_{KE}$. Angular key velocity $\Omega_K$ is the integral 410 of this acceleration and angular key displacement $\theta_K$ is the integral 412 of velocity $\Omega_K$. Linear key velocity $V_K$ and displacement $\delta_K$ are proportional to angular velocity $\Omega_K$ and displacement $\theta_K$ respectively through moment arm $L_P$. Net key force $\Sigma F$ is a linear equivalent of torque sum $\Sigma T_K$ scaled by the inverse of moment arm $L_P$.

Equivalent friction torque $T_{FE}$ and motor velocity $\Omega_M$ are related to key velocity $\Omega_K$ by coulomb friction model 414 and drive ratio n, respectively. Motor voltage $V_M$ is given by the sum of motor back EMF voltage $V_B$ and the product of motor current $I_M$ and motor resistance $R_M$. Back EMF voltage $V_B$ is in turn proportional to motor velocity $\Omega_M$ by motor back EMF constant $K_B$. Motor torque $T_M$ is proportional to motor current $I_M$ by motor torque constant $K_T$.

The fixed tactile parameters of playing key 20 are a static imbalance torque given by the product of key weight W and moment arm $L_W$, and equivalent key inertia $J_{KE}$. The effective key imbalance and inertia sensed by the performer is a function of the fixed parameters and input motor current $I_M$.

The variables of playing key 20 that influence the dynamic response of keyboard 8 are key displacement $\delta_K$, key velocity $V_K$ and net key force $\Sigma F$. Key displacement $\delta_K$ controls the engagement of switch 42 and the state of key switch on/off discrete 44a. Estimates of key velocity $V_K$ and net key force $\Sigma F$ are used by dynamic response controller 334 and MIDI interface controller 336 to control sound generation in slave modules 302.

OPERATION—MOTOR CONTROLLER

Motor controller 330 of controller keyboard 300 linearly controls motor currents 376 in response to current commands 378, and senses motor voltage 380 and current 376 to develop an estimate of motor back EMF voltage 382.

Figure 7A:
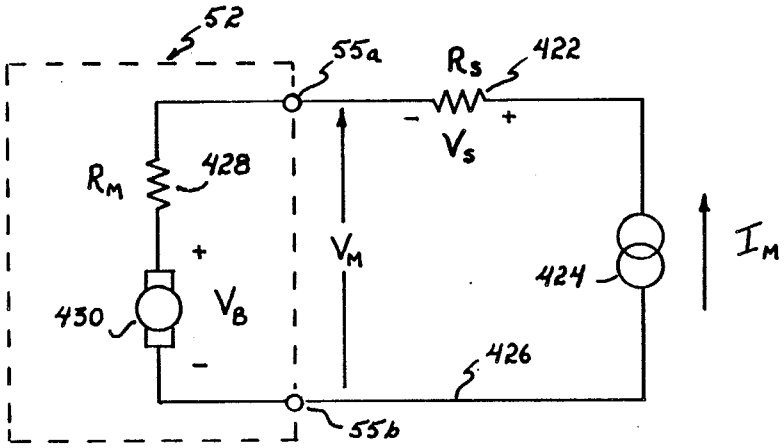
FIG. 7*a* is an electrical schematic illustrating current control of a motor.

FIG. 7a is an electrical schematic illustrating current control of motor 52 of keyboard 18. Motor 52 is connected to series current sensing resistor 422 and current source 424 at motor terminals 55a and 55b to form current loop 426. Motor 52 is represented by series motor resistance 428 and back EMF voltage source 430 as given by EQN.[29] of the equations of motion. In loop 426, current source 424 maintains a constant motor current $I_M$ irregardless of fluctuations in motor voltage $V_m$ sensed across motor terminals 55a and 55b. Voltage drop $V_S$ across current sensing resistor 422 is:

$$V_S = I_M * R_S \quad [34]$$

To provide linear control of motor current $I_M$, current source 424 must respond proportionally to current commands $U_C$. From EQN.[31] then, $$I_M = K_C * U_C \quad [35]$$

where $U_C$ becomes the motor control command $u_C$.

Figure 7B:
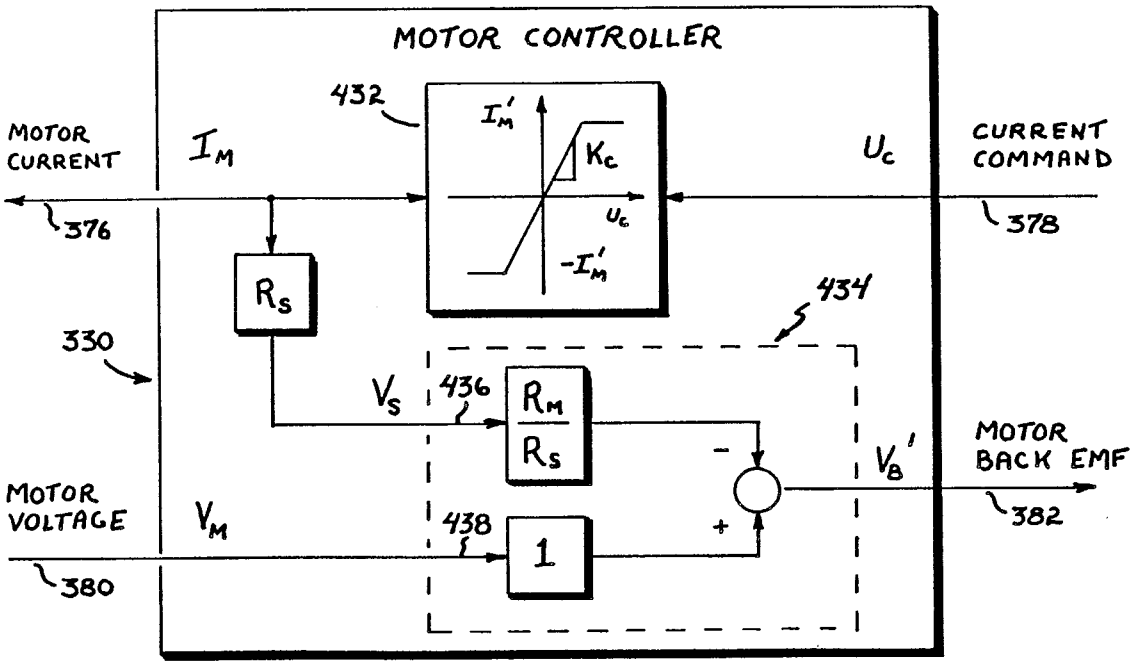
FIG. 7*b* is a block diagram representation of a motor controller.

FIG. 7b is a functional block diagram of motor controller 330. Current amplifier 432 implements EQN.[35] with current limiting $(-I_M' \leqq I_M \leqq +I_M')$ to prevent damage to motor 52. There are a number of conventional techniques for current control in DC motors. For example, current amplifier 432 can comprise a voltage amplifier or pulse width modulation circuit, both employing current feedback. In either case the current feedback is provided by current sensing resistor 424 and motor current 376 is proportional to command 378 in the mean.

By EQN.[29], back EMF voltage can be derived from motor voltage and current:

$$V_B = V_M - I_M * R_M \quad [36]$$

Accordingly, the output of voltage amplifier 434 is an estimate of motor back EMF $V_B'$ given motor voltage $V_M$ and current sensing voltage $V_S$ as inputs. The gain of inverting channel 436 of amplifier 434 is the ratio of the motor to current sensing resistance $(R_M/R_S)$. The gain of noninverting channel 438 is unity:

$$V_B' = (1.0) * V_M - (R_M/R_S) * V_S \quad [37]$$

Motor controller 330 can alternately control motor 52 with a voltage amplifier as suggested by EQN.[30], but the corresponding control law must include compensation for motor back EMF effects to insure linear control of motor torque.

OPERATION—TACTILE RESPONSE CONTROLLER

Tactile response controller 332 develops current commands 378 from an estimate of motor back EMF 382 and performer adjusted tactile parameters, balance 344 and inertia 346. Estimates of key velocity 384 and net key force 386 are also derived from motor back EMF 382.

Figure 8:
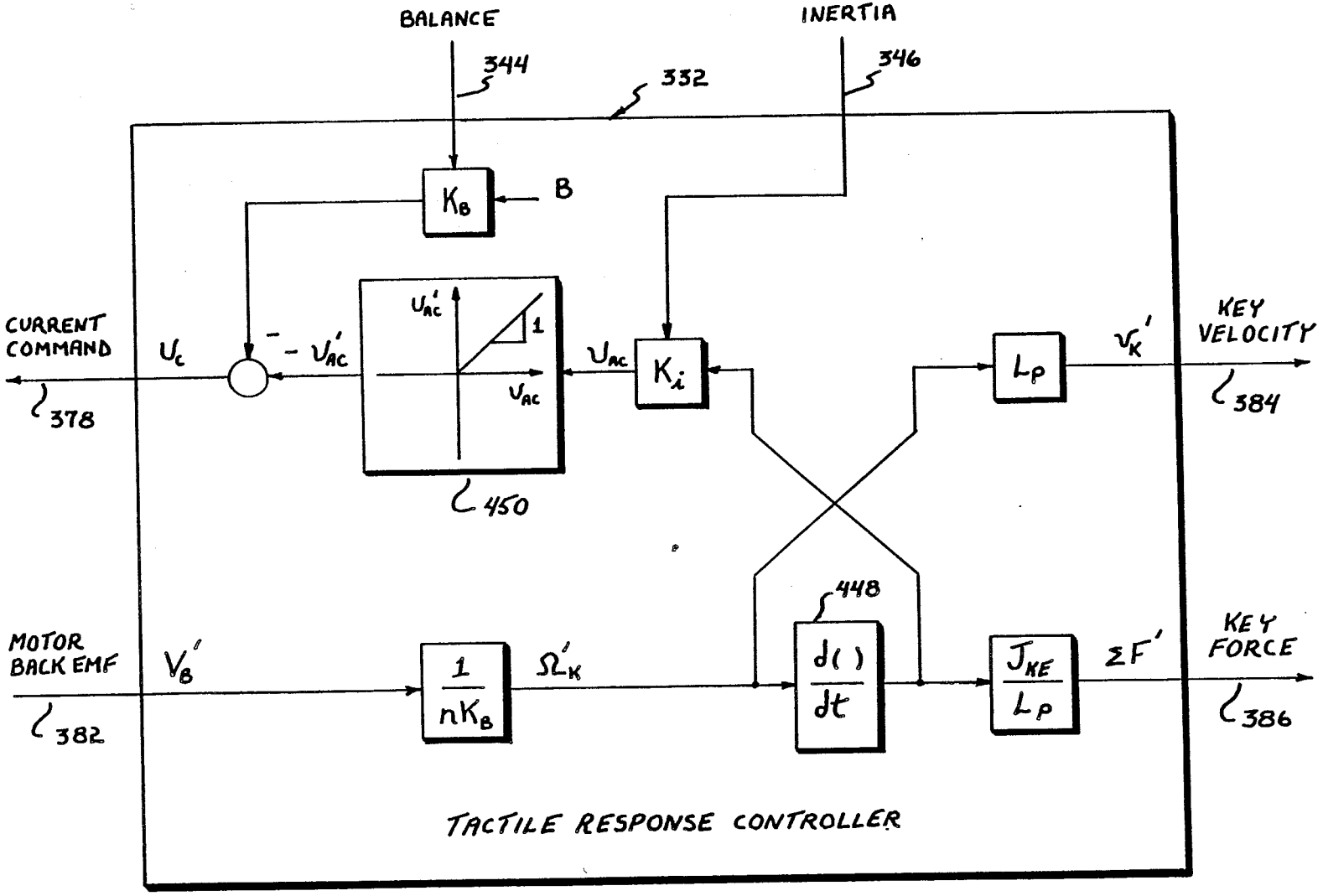
FIG. 8 is a block diagram representation of a tactile response controller.

FIG. 8 is a functional block diagram of tactile response controller 332. An estimate of key angular velocity $\Omega_K'$ is derived from motor back EMF $V_B'$ by combining EQN.[6] and EQN.[28]:

$$\Omega_K' = (1/n*K_B)*V_B' \quad [38]$$

The time derivative 448 of $\Omega_K'$ is scaled by inertia parameter $K_i$ to develop the AC component $U_{AC}$ of current command $U_C$:

$$U_{AC} = K_i * \frac{d}{dt}(\Omega_K') \quad [39]$$

The DC component $U_{DC}$ of command $U_C$ is given by positive bias term B scaled by balance parameter $K_b$:

$$U_{DC} = K_b * B \quad [40]$$

The AC component $U_{AC}$ is input to half-wave rectifier 450. Current command $U_C$ is the inverted sum of DC component $U_{DC}$ and output $U_{AC}'$ of rectifier 450 as given by the following feedback control law, $$U_C = \begin{cases} -U_{DC} & \text{, if } U_{AC} \leqq 0 \\ -U_{DC} - U_{AC} & \text{, if } U_{AC} > 0 \end{cases} \quad [41]$$

Assuming for the moment that the estimate of key velocity is error free (i.e. $\Omega_K' = \Omega_K$), the new key dynamics result by substitution of EQNS.[26], [39], [40] and [41] into EQN.[15], $$F_P * L_P - W_{EFF} * L_W - T_{FE} = J_{EFF} * \frac{d}{dt}(\Omega_K) \quad [42]$$

where $W_{EFF}$ and $J_{EFF}$ are the effective imbalance and inertia:

$$W_{EFF} = W + (n*K_T*K_C*K_b*B/L_W) \quad [43]$$

$$J_{EFF} = \begin{cases} J_{KE} & \text{, if } U_{AC} \leqq 0 \\ J_{KE} + n * K_T * K_c * Ki & \text{, if } U_{AC} > 0 \end{cases} \quad [44]$$

By EQN.[43] then, the key imbalance can be modified electrically by selection of the sign and magnitude of balance parameter $K_b$. For $K_b=0$, the performer experiences the true physical imbalance of key 20. For a positive $K_b$, the performer experiences a "stiffer" action; for negative $K_b$, a "softer" action. To insure there is sufficient torque to return the key to its rest position, the negative range of $K_b$ must be limited as a function of equivalent key friction magnitude $T_{FE}'$:

$$K_b > \frac{(T_{FE}' - W * L_W)}{n * K_T * K_c * B} \text{, for } K_b < 0 \quad [45]$$

EQN.[44] indicates that the effective key inertia can also be modified electrically by selection of the sign and magnitude of inertia parameter $K_i$. When the performer initially attacks the key, the key acceleration is positive. If Ki is also positive, the second condition of EQN.[44] is satisfied ($U_{AC}>0$) and the performer senses an increase in inertial resistance. As the performer releases the key, the acceleration changes sign and the first condition is satisfied. Accordingly, the effective inertia is decreased to the level of the true physical inertia and the key returns quickly to its rest position.

The above response is analogous to a piano action. The performer initially encounters a large effective inertia when the hammer is accelerated thru the leverage of the action. When the hammer leaves the escapement to strike the string, the inertial resistance suddenly decreases. As the hammer returns to the escapement, its momentum helps to rapidly restore the key. Quick release dynamics are important since they cause the key to track the performer's fingers at fast tempo.

If a negative $K_i$ is selected, the initial attack will result in a negative AC component $U_{AC}$ and the performer will only encounter the true physical key inertia. Upon release, $U_{AC}$ changes sign and the effective inertia is reduced below the level of key inertia $J_{KE}$. This results in a very fast key restoration. An increasingly negative $K_i$ continues to improve the release dynamics until current saturation in motor 42. The theoretical lower limit for $K_i$ is apparent by consideration of EQN.[44] and [42]:

$$K_i > -\frac{J_{KE}}{n * K_T * K_c} \quad [46]$$

Since the variation of effective key inertia $J_{KE}$ requires a feedback control loop, stability considerations further limit the upper and lower bounds of inertia parameter $K_i$. For example time constants associated with the differentiation of the motor back EMF voltage (EQNS.[38] and [39]) and processing delays will cause loop instability if $K_i$ is increased too much in either the positive or negative direction. However, the application of standard control system design practices to the present invention should result in a broad adjustment range for the effective key inertia $J_{KE}$ and provide a robust controller that is substantially insensitive to errors (e.g., scale factor error, noise) in the key velocity estimate.

Controller 332 also develops an estimate of linear key velocity $v_K'$ and net key force $\Sigma F'$ from the estimate of angular key velocity $\Omega_K'$. By EQN.[22] the linear key velocity estimate is given by:

$$v_K' = L_P * \Omega_K' \quad [47]$$

The net force estimate is defined as the time derivative of the key velocity estimate $\Omega_K$, scaled by the ratio of the equivalent key inertia $J_{KE}$ and moment arm $L_P$:

$$\Sigma F' = \frac{J_{KE}}{L_P} * \frac{d}{dt}(\Omega_K') \quad [48]$$

OPERATION—DYNAMIC RESPONSE CONTROLLER

Dynamic response controller 334 develops response variable 400 from key velocity estimate 384, net key force estimate 386, VELOCITY mode state 396, FORCE mode state 398, velocity scale parameter 348 and force scale parameter 350. If VELOCITY state 396 is active, response variable 400 is equal to key velocity estimate 384 scaled by velocity scale parameter 384. If FORCE state 398 is active, response variable 400 is equal to key force estimate 386 scaled by force scale parameter 350. Estimates 384 and 386 are also compared to velocity and force thresholds to determine the state of key on/off discrete 402. Threshold scale parameter 352 determines threshold sensitivity.

FIG. 9 is a data dictionary of inputs, outputs, local variables and constants for a dynamic response control algorithm. FIG. 10*a* is a pseudo code description of the algorithm with the necessary imputs, outputs, algebraic and boolean expressions to satisfy the previously defined moding and processing requirements for controller 334. FIGS. 10*b*, 11*a*, 11*b* and 12 are pseudo code descriptions of procedures that support the sequential execution of the dynamic response control algorithm of FIG. 10*a*.

OPERATION—MIDI INTERFACE CONTROLLER

Midi Interface Controller 336 is comprised of a control processor and MIDI transmitter. Controller 336 sequentially polls key on/off discrete 402 and key switch on/off discrete 44*a* for each key 20 of keyboard 18. PIANO mode state 392 and PERCUSSION mode state 394 are input to controller 336 and together with discretes 402 and 44*a*, determine whether MIDI data will be formatted and stored in a MIDI buffer for any one key. The content of the MIDI data is determined from mode states 392 and 394, offset parameter input 356 and response variable input 400. Asynchronous to key polling, normal MIDI processing empties the contents of the buffer in "first-in first-out" order through serial transmissions of MIDI data via MIDI OUT port 314. Normal MIDI processing is controlled by MIDI mode input 388 and MIDI input parameters 354.

FIG. 13 is data dictionary of inputs, outputs, local variables and constants for a MIDI interface control algorithm. FIG. 14*a* is a pseudo code description the algorithm with the necessary inputs, outputs, algebraic and boolean expressions to poll keyboard 18, determine touch response mode and format and store MIDI data. FIGS. 14*b*, 15*a*, 15*b* and 16 are pseudo code descriptions of procedures that support the sequential execution of the MIDI Interface Control Algorithm of FIG. 14*a*.

Normal MIDI processing and transmission of data conform to MIDI Specification 1.0 and are not further described. Sequential execution of the MIDI Interface Control Algorithm together with asynchronous MIDI processing and MIDI data transmission satisfy the previously defined moding and processing requirements for MIDI Interface Controller 336.

CONCLUSION

Although a specific environment for the keyboard of the present invention has been shown in FIGS. 4 and 5, other implementations are possible. For example the keyboard could be imbedded in a keyboard instrument with internal sound generating capability such as a synthesizer, electronic piano or organ. Furthermore some systems might implement the previously described tactile or dynamic response control alone since these functions are separable.

While the invention has been described as having a preferred design, it will be understood that it is capable of further modification. This application is, therefore, intended to cover any variations, uses or adaptations of the invention following the general principles thereof and including such departures from the present disclosure as come within known or customary practice in the art to which this invention pertains and fall within the limits of the appended claims.

What is claimed is:

1. A keyboard system for an electronic musical instrument, adapted to enable a desired tactile response of keys in the keyboard system to be effected by performer adjustment of tactile response parameters associated with a keyboard touch response, comprising:

(a) a keyboard, including:
  (1) a base structure;
  (2) a plurality of playing keys adapted to be pivotally mounted on the base structure and to be linearly arranged in the keyboard; and
  (3) means for pivotally mounting and linearly arranging the plurality of playing keys in the base structure;

(b) a plurality of electromechanical key actuation and sensing elements, associated with the keyboard, including:
  (1) a plurality of electric motors mounted in said base structure, for generating motor output torque, a back electromotive force that is a function of the speed of said motors, and electrical parameters including current and voltage levels;
  (2) means for coupling the electric motors to said keys so as to transmit motor output torque from said motors to said keys;
  (3) electrical means for sensing a motor electrical parameter; and
  (4) motor control means for controlling said motor output torques and for developing estimates of said motor back electromotive forces from said sensed motor electrical parameter;

(c) performer interface means for enabling performer adjustment of tactile response parameters associated with said keyboard touch response; and (d) electronic processing means for generating motor control commands for controlling motor output torque in said motor control means in response to said tactile response parameters and said estimates of motor back electromotive force, whereby a desired tactile response of said keys is effected by said performer adjustment of said tactile response parameters.

2. The keyboard system of claim 1, wherein said coupling means include a single cable spool drive means comprising:

a stop means secured to said base structure at the rearward end of said key;

a cylindrical spool affixed to an output shaft of said motor; and a cable means secured at one end to said spool, wound about said spool and secured at an opposite end to the rearward end of said key;

whereby said drive means unilaterally transmits a torque produced by said motor to said key through said cable in a direction to oppose a depression of said key, such that a tension is maintained in said cable and said key is returned to said stop when said key is released.

3. The keyboard system of claim 1, wherein said motor control means includes a current source means for sourcing a continuous current to each said motor that is proportional in the mean to said motor control command.

4. The keyboard system of claim 1, wherein said motor control means includes a voltage source means for applying a continuous voltage to each said motor that is proportional in the mean to said motor control command.

5. The keyboard system of claim 1, wherein said tactile response parameters include a balance and an inertia parameter.

6. The keyboard system of claim 5, wherein said motor control commands in said electronic processing means are generated in accordance with a feedback control law which comprises:

a computation of a DC component of said motor control command from a fixed bias scaled by said balance parameter;

a computation of a half wave rectified AC component of said motor control command from a time derivative of said back electromotive force estimate scaled by said inertia parameter; and a summation of said DC component and said half wave rectified AC component to develop said motor control command;

whereby said DC component alters effective key imbalance in proportion to said balance parameter by causing said motor to exert a static torque on said key, and said half wave rectified AC component alters effective key inertia in proportion to said inertia parameter by causing said motor to exert a dynamic torque on said key in a direction to resist performer depression of said key.

7. The keyboard system of claim 1, wherein said key is guided and pivoted by a vee block means comprising;

a key balance rail means secured to said base structure;

a vee block secured to the underside of said key; and a blade means secured to said balance rail and fitting into said vee block to serve as a support and fulcrum for said key and to constrain side-to-side motion of said key;

whereby said vee block means accurately guides and provides a low friction pivot for said key.

8. The keyboard system of claim 1, wherein said electric motor and is a DC permanent magnet ironless core motor, whereby the armature inductance and inertia of said motor are substantially less when compared to conventional DC motors of similar size and torque output.

9. The keyboard system of claim 1, wherein said coupling means is dual cable spool drive means comprising:

a stop means secured to said base structure at the rearward end of said key;

a cylindrical spool affixed to an output shaft of said motor;

a cable tensioner means with a forward and rearward attachment point;

a first pulley support means secured to said base structure below the rearward end of said key;

a first cable means secured at one end to said cable tensioner rearward attachment point, wound about said spool and secured at an opposite end to the rearward end of said key along the longitudinal centerline of said key and at a given distance from a fulcrum of said key;

a first pulley means secured to said first pulley support means to receive said first cable means from said spool and to guide said cable to said rearward key attachment;

a second pulley support means secured to said base structure below the forward end of said key;

a second cable means secured at one end to said cable tensioner forward attachment point, secured at an opposite end to the forward end of said key along the longitudinal centerline of said key and at an equal distance from a fulcrum of said key; and a second pulley means secured to said second pulley support means to receive said second cable means from said cable tensioner and to guide said cable forward key attachment;

whereby said drive means bilaterally transmits a torque produced by said motor to said key through said cables, said cable tensioner maintains a tension in said cables without exerting a net torque on said key and exerts a net downward force on said fulcrum.

10. A keyboard system for an electronic musical instrument, adapted to enable a desired tactile response of keys in the keyboard system to be effected by performer adjustment of tactile response parameters associated with a keyboard touch response and a desired touch sensitive tone response to be effected by performer adjustment of dynamic response parameters, comprising:

(a) a keyboard, including:

(1) a base structure;

(2) a plurality of playing keys adapted to be pivotally mounted on the base structure and to be linearly arranged in the keyboard; and (3) means for pivotally mounting and linearly arranging the plurality of playing keys in the base structure;

(b) a plurality of electromechanical key actuation and sensing elements, associated with the keyboard, including:

(1) a plurality of electric motors mounted in said base structure, for generating motor output torque, a back electromotive force that is a function of the speed of said motors, and electrical parameters including current and voltage levels;

(2) means for coupling the electric motors to said keys so as to transmit motor output torque from said motors to said keys;

(3) electrical means for sensing a motor electrical parameter; and (4) motor control means for controlling said motor output torques and for developing estimates of said motor back electromotive forces from said sensed motor electrical parameter;

(c) performer interface means for enabling performer adjustment of tactile and dynamic response parameters associated with said keyboard touch reponse;

(d) means for generating a distinct note on/off discrete for each of said keys in accordance with said performer playing said keyboard;

(e) musical interface means for outputting said note on/off discretes to a plurality of musical tone generators for causing distinct touch sensitive tonal outputs upon actuation of said keys; and (f) electronic processing means for generating motor control commands for controlling motor input torque in said motor control means in response to said tactile and dynamic response parameters and said estimates of motor back electromotive force and for generating tone control commands for outputting in said musical interface means, whereby a desired tactile response of said keys is effected by said performer adjustment of said tactile response parameters and a desired touch sensitive tone response is effected by said performer adjustment of said dynamic response parameters.

11. The keyboard system of claim 10, wherein the means for generating said distinct note on/off discrete comprises:

an electrical switch means for each said key which is actuated upon depression of said key;

a stop means secured to said base structure near a forward end of said key;

a resilient means secured to said stop means to support said switch means, whereby a fixed depression of said key engages said switch means and a further depression of said key is resisted by said resilient means; and a key switch on/off discrete which is electrically set by said switch means when said key engages said switch and which is reset when said switch is not so engaged;

whereby said means for generating said note on/off discrete sets said discrete at a point before said key reaches a full depression.

12. The keyboard system of claim 7, wherein said electronic processing means includes means for developing a key velocity estimate and a net key force estimate for each said key.

13. The keyboard of claim 12, wherein said dynamic response parameters include a threshold scale parameter.

14. The keyboard system of claim 13, wherein the means for generating said distinct note on/off discrete includes an electronic processing means to algorithmically determine the state of a note on/off discrete for each said key by a plurality of logical combinations of said velocity and net force estimates of said key and a subsequent comparison of said combinations with a plurality of thresholds scaled by said threshold parameter, whereby note on/off control is a function of percussive attack.

15. The keyboard system of claim 14, wherein said performer interface means includes a means for activating and deactivating a piano and a percussion mode state.

16. The keyboard system of claim 15, wherein the means for determining the state of said note on/off discrete is a selectable means comprising:

an electrical switch means for each said key which is actuated upon depression of said key;

a stop means secured to said base structure near a forward end of said key;

a resilient means secured to said stop means to support said switch means, whereby a fixed depression of said key engages said switch means and a further depression of said key engages said switch means and a further depression of said key is resisted by said resilient means;

a key switch on/off discrete which is electrically set by said switch means when said key engages said switch and which is reset when said switch is not so engaged;

a prioritization rule to allow multiple sounding of notes for a single depression of said key;

an electonic processing means to algorithmically determine the state of a key on/off discrete for each said key by a plurality of logical combinations of said velocity and net force estimates of said key and a subsequent comparison of said combinations with a plurality of thresholds scaled by said threshold parameter; and an electronic processing means to algorithmically equivalence the state of said note on/off discrete with said key switch on/off discrete if said piano mode state is active, to equialence the state of said note on/off state with said key on/off state if said percussion state is active and to arbitrate said equivalencing of said note on/off state according to said prioritization rule if both said mode states are active;

whereby said selectable means allows said performer to select between a note initiated by a fixed depression of said key, by percussive attack, or by a combination that results in the multiple sounding of a note.

17. The keyboard system of claim 16, wherein said dynamic response parameters include a velocity scale and a force scale parameter.

18. The keyboard system of claim 17, wherein said performer interface means includes a means for activating and deactivating a velocity and a force mode state.

19. The keyboard system of claim 18, wherein said tone control command is equal to said net force estimate scaled by said force scale parameter if said force mode state is active, whereby a performer can select between a force touch response sensitivity and can adjust said sensitivity.

20. The keyboard system of claim 18, wherein said tone control command is equal to said velocity estimate scaled by said velocity scale parameter if said velocity mode state is active, whereby a performer can select a velocity touch response sensitivity and can adjust said sensitivity.

21. The keyboard system of claim 20, wherein said tone control command is equal to said net force estimate scaled by said force scale parameter if said force mode state is active, whereby a performer can select a force touch response sensitivity and can adjust said sensitivity.

22. The keyboard system of claim 12, wherein said dynamic response parameters include a velocity scale and a force scale parameter.

23. The keyboard system of claim 22, wherein said performer interface means includes a means for activating and deactivating a velocity and a force mode state.

24. The keyboard system of claim 23, wherein said tone control command is equal to said velocity estimate scaled by said velocity scale parameter if said velocity mode state is active, whereby a performer can select a velocity touch response senstivity and can adjust said sensitivity.

25. The keyboard system of claim 10, wherein said coupling means include a single cable spool drive means comprising:

a stop means secured to said base structure at the rearward end of said key;

a cylindrical spool affixed to an output shaft of said motor; and a cable means secured at one end to said spool, wound about said spool and secured at an opposite end to the rearward end of said key;

whereby said drive means unilaterally transmits a torque produced by said motor to said key through said cable in a direction to oppose a depression of said key, such that a tension is maintained in said cable and said key is returned to said stop when said key is released.

26. The keyboard system of claim 10, wherein said motor control means includes a current source means for sourcing a continuous or pulsed current to each said motor that is proportional in the mean to said motor control command.

27. The keyboard system of claim 10, wherein said motor control means include a voltage source means for applying a continuous or pulsed voltage to each said motor this is proportional in the mean to said motor control command.

28. The keyboard system of claim 10, wherein said tactile response parameters include a balance and an inertia parameter.

29. The keyboard system of claim 28, wherein said motor control commands in said electronic processing means are generated in accordance with a feedback control law which comprises:

a computation of a DC component of said motor control command from a fixed bias scaled by said balance parameter;

a computation of a half wave rectified AC component of said motor control command from a time derivative of said back electromotive force estimate scaled by said inertia parameter; and a summation of said DC component and said half wave rectified AC component to develop said motor control command;

whereby said DC component alters effective key imbalance in proportion to said balance parameter by causing said motor to exert a static torque on said key, and said half wave rectified AC component alters effective key inertia in proportion to said inertia parameter by causing said motor to exert a dynamic torque on said key in a direction to resist performer depression of said key.

30. The keyboard system of claim 10, wherein said key is guided and pivoted by a vee block means comprising;

a key balance rail means secured to said base structure;

a vee block secured to the underside of said key; and a blade means secured to said balance rail and fitting into said vee block to serve as a support and fulcrum for said key and to constrain side-to-side motion of said key;

whereby said vee block means accurately guides and provides a low friction pivot for said key.

31. The keyboard system of claim 10, wherein said electric motor is a DC permanent magnet ironless core motor, whereby the armature inductance and inertia of said motor are substantially less when compared to conventional DC motors of similar size and torque output.

32. The keyboard system of claim 10, wherein said coupling means is dual cable spool drive means comprising:

a stop means secured to said base structure at the rearward end of said key;

a cylindrical spool affixed to an output shaft of said motor;

a cable tensioner means with a forward and rearward attachment point;

a first pulley support means secured to said base structure below the rearward end of said key;

a first cable means secured at one end to said cable tensioner rearward attachment point, wound about said spool and secured at an opposite end to the rearward end of said key along the longitudinal centerline of said key and at a given distance from a fulcrum of said key;

a first pulley means secured to said first pulley support means to receive said first cable means from said spool and to guide said cable to said rearward key attachment;

a second pulley support means secured to said base structure below the forward end of said key;

a second cable means secured at one end to said cable tensioner forward attachment point, secured at an opposite end to the forward end of said key along the longitudinal centerline of said key and at an equal distance from a fulcrum of said key; and a second pulley means secured to said second pulley support means to receive said second cable means from said cable tensioner and to guide said cable forward key attachment;

whereby said drive means bilaterally transmits a torque produced by said motor to said key through said cables, said cable tensioner maintains a tension in said cables without exerting a net torque on said key and exerts a net downward force on said fulcrum.

33. A keyboard system for an electronic musical instrument, adapted to enable a desired touch sensitive tone response to be effected by performer adjustment of dynamic response parameters, comprising:

(a) a keyboard, including:

(1) a base structure;

(2) a plurality of playing keys adapted to be pivotally mounted on the base structure and to be linearly arranged in the keyboard; and (3) means for pivotally mounting and linearly arranging the plurality of playing keys in the base structure;

(b) a plurality of electromechanical key actuation and sensing elements, associated with the keyboard, including:

(1) a plurality of electric motors mounted in said base structure for producing a back electromotive force that is a function of the speed of said motors;

(2) means for respectively coupling said motors to said keys such that a rotation of said key will cause a corresponding rotation of said motor;

(3) electrical means for respectively sensing voltages of said motors;

(4) motor interface means for respectively developing estimates of said motor back electromotive forces from said sensed motor voltages;

(c) performer interface means for enabling performer adjustment of dynamic response parameters associated with said keyboard touch response;

(d) means for determining a distinct note on/off discrete for each of said keys in accordance with said performer palying said keyboard;

(e) musical interface menas for outputting said note on/off discretes to a plurality of musical tone generators for causing distinct touch sensitive tonal outputs upon actuation of said keys; and (f) electronic processing means for generating said tone control commands for controlling motor output torque in said motor control means in response to said dynamic response parameters and said estimates of motor back electromotive force, whereby a desired touch sensitive tone response is effected by said performer adjustment of said dynamic response parameters.

34. The keyboard system of claim 33, wherein the means for generating said distinct note on/off discrete comprises:

an electrical switch means for each said key which is actuated upon depression of said key;

a stop means secured to said base structure near a forward end of said key;

a resilient means secured to said stop means to support said switch means, whereby a fixed depression of said key engages said switch means and a further depression of said key is resisted by said resilient means; and a key switch on/off discrete which is electrically set by said switch means when said key engages said switch and which is reset when said switch is not so engaged;

whereby said means for generating said note on/off discrete sets said discrete at a point before said key reaches a full depression.

35. The keyboard system of claim 33, wherein said electronic processing means includes means for developing a key velocity estimate and a net key force estimate for each said key.

36. The keyboard system of claim 35, wherein said dynamic response parameters include a threshold scale parameter.

37. The keyboard system of claim 36, wherein the means for generating said distinct note on/off discrete includes an electronic processing means to algorithmically determine the state of a note on/off discrete for each said key by a plurality of logical combinations of said velocity and net force estimates of said key and a subsequent comparison of said combinations with a plurality of thresholds scaled by said threshold parameter, whereby note on/off control is a function of percussive attack.

38. The keyboard system of claim 37, wherein said performer interface means includes a means for activating and deactivating a piano and a percussion mode state.

39. The keyboard system of claim 38, wherein the means for determining the state of said note on/off discrete is a selectable means comprising:

an electrical switch means for each said key which is actuated upon depression of said key;

a stop means secured to said base structure near a forward end of said key;

a resilient means secured to said stop means to support said switch means, whereby a fixed depression of said key engages said switch means and a further depression of said key is resisted by said resilient means;

a key switch on/off discrete which is electrically set by said switch means when said key engages said switch and which is reset when said switch is not so engaged;

a prioritization rule to allow multiple sounding of notes for a single depression of said key;

an electonic processing means to algorithmically determine the state of a key on/off discrete for each said key by a plurality of logical combinations of said velocity and net force estimates of said key and a subsequent comparison of said combinations with a plurality of thresholds scaled by said threshold parameter; and an electronic processing means to algorithmically equivalence the state of said note on/off discrete with said key switch on/off discrete if said piano mode state is active, to equialence the state of said note on/off state with said key on/off state if said percussion state is active and to arbitrate said equivalencing of said note on/off state according to said prioritization rule if both said mode states are active;

whereby said selectable means allows said performer to select between a note initiated by a fixed depression of said key, by percussive attack, or by a combination that results in the multiple sounding of a note.

40. The keyboard system of claim 33, wherein said key is guided and pivoted by a vee block means comprising;

a key balance rail means secured to said base structure;

a vee block secured to the underside of said key; and a blade means secured to said balance rail and fitting into said vee block to serve as a support and fulcrum for said key and to constrain side-to-side motion of said key;

whereby said vee block means accurately guides and provides a low friction pivot for said key.

41. The keyboard system of claim 33, wherein said electric motor is a DC permanent magnet ironless core motor, whereby the armature inductance and inertia of said motor are substantially less when compared to conventional DC motors of similar size and torque output.

42. The keyboard system of claim 33, wherein said coupling means is dual cable spool drive means comprising:

a stop means secured to said base structure at the rearward end of said key;

a cylindrical spool affixed to an output shaft of said motor;

a cable tensioner means with a forward and rearward attachment point;

a first pulley support means secured to said base structure below the rearward end of said key;

a first cable means secured at one end to said cable tensioner rearward attachment point, wound about said spool and secured at an opposite end to the rearward end of said key along the longitudinal centerline of said key and at a given distance from a fulcrum of said key;

a first pulley means secured to said first pulley support means to receive said first cable means from said spool and to guide said cable to said rearward key attachment;

a second pulley support means secured to said base structure below the forward end of said key;

a second cable means secured at one end to said cable tensioner forward attachment point, secured at an opposite end to the forward end of said key along the longitudinal centerline of said key and at an equal distance from a fulcrum of said key; and a second pulley means secured to said second pulley support means to receive said second cable means from said cable tensioner and to guide said cable forward key attachment;

whereby said drive means bilaterally transmits a torque produced by said motor to said key through said cables, said cable tensioner maintains a tension in said cables without exerting a net torque on said key and exerts a net downward force on said fulcrum.

* * * * *